US011526093B2

(12) United States Patent
Kawaguchi

(10) Patent No.: US 11,526,093 B2
(45) Date of Patent: Dec. 13, 2022

(54) TONER, TONER CARTRIDGE, AND IMAGE FORMING APPARATUS

(71) Applicant: TOSHIBA TEC KABUSHIKI KAISHA, Tokyo (JP)

(72) Inventor: Hiroshi Kawaguchi, Ashigarakami Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 91 days.

(21) Appl. No.: 17/232,048

(22) Filed: Apr. 15, 2021

(65) Prior Publication Data

US 2022/0066343 A1 Mar. 3, 2022

(30) Foreign Application Priority Data

Sep. 1, 2020 (JP) ..... JP2020-146607

(51) Int. Cl.

| | |
|---|---|
| ***G03G 9/087*** | (2006.01) |
| ***G03G 9/097*** | (2006.01) |
| ***G03G 9/08*** | (2006.01) |
| ***G03G 15/08*** | (2006.01) |

(52) U.S. Cl.

CPC ..... *G03G 9/09725* (2013.01); *G03G 9/0819* (2013.01); *G03G 9/08755* (2013.01); *G03G 9/08782* (2013.01); *G03G 15/0865* (2013.01)

(58) Field of Classification Search

CPC ..... G03G 9/08755; G03G 9/08782; G03G 9/09725

See application file for complete search history.

(56) References Cited

U.S. PATENT DOCUMENTS

| | | | |
|---|---|---|---|
| 5,512,406 | A | 4/1996 | Takeda et al. |
| 6,555,281 | B1 | 4/2003 | Nozawa et al. |
| 9,335,667 | B1 | 5/2016 | Zona et al. |
| 2003/0224278 | A1 | 12/2003 | Shirai et al. |
| 2006/0286475 | A1 | 12/2006 | Kawaguchi |
| 2011/0281214 | A1 | 11/2011 | Kuroyama |
| 2011/0294060 | A1 | 12/2011 | Yasutomi |
| 2013/0164669 | A1 | 6/2013 | Yamashita et al. |
| 2013/0171555 | A1 | 7/2013 | Kubo et al. |

(Continued)

FOREIGN PATENT DOCUMENTS

| | | |
|---|---|---|
| EP | 3 106 923 A1 | 12/2016 |
| JP | H03-200184 | 9/1991 |

(Continued)

OTHER PUBLICATIONS

Extended European Search Report dated Nov. 4, 2021 issued in EP Application No. 21177067.2, 6 pages.

*Primary Examiner* — Peter L Vajda
(74) *Attorney, Agent, or Firm* — Foley & Lardner LLP

(57) ABSTRACT

According to one embodiment, a toner which has excellent low-temperature fixability, and also has excellent heat resistance even when the toner is reused, sufficiently maintains an electric charge amount, and hardly decreases an image density is provided. Also provided are a toner cartridge and an image forming apparatus, in each of which the toner is stored.

A toner according to an embodiment contains toner base particles and an external additive. The external additive contains silica particles A, B, and C having a particle diameter of 10 to 14 nm, 40 to 70 nm, and 90 to 150 nm, respectively.

19 Claims, 5 Drawing Sheets

(56) References Cited

U.S. PATENT DOCUMENTS

| | | | | |
|---|---|---|---|---|
| 2014/0170555 | A1 | 6/2014 | Wosnick et al. | |
| 2015/0309431 | A1 | 10/2015 | Katsumata et al. | |
| 2015/0309435 | A1 | 10/2015 | Kuroyama et al. | |
| 2017/0261876 | A1 | 9/2017 | Kabata et al. | |
| 2017/0363983 | A1* | 12/2017 | Kuroyama ..... | G03G 9/08 |
| 2018/0074421 | A1 | 3/2018 | Uchino et al. | |
| 2018/0181013 | A1 | 6/2018 | Chiba | |
| 2018/0259886 | A1 | 9/2018 | Ajima | |

FOREIGN PATENT DOCUMENTS

| | | | |
|---|---|---|---|
| JP | 2004-163846 | | 6/2004 |
| JP | 2004-354813 | | 12/2004 |
| JP | 2005-107387 | A | 4/2005 |
| JP | 3693327 | B2 | 9/2005 |
| JP | 2009-163052 | | 7/2009 |
| JP | 2009-181005 | A | 8/2009 |
| JP | 2010-002748 | A | 1/2010 |
| JP | 2011-039544 | | 2/2011 |
| JP | 2012-027142 | A | 2/2012 |
| JP | 2012-067043 | A | 4/2012 |
| JP | 2017-173411 | | 9/2017 |
| JP | 2018-173499 | | 11/2018 |
| JP | 2019-168529 | A | 10/2019 |

* cited by examiner

TONER, TONER CARTRIDGE, AND IMAGE FORMING APPARATUS

CROSS-REFERENCE TO RELATED APPLICATION

This application is based upon and claims the benefit of priority from Japanese Patent Application No. 2020-146607, filed on Sep. 1, 2020 the entire contents of which are incorporated herein by reference.

FIELD

The embodiments described herein relate generally to a toner, a toner cartridge, and an image forming apparatus.

BACKGROUND

A toner containing a crystalline polyester resin (for example, Japanese Patent No. 3693327) is known. The toner containing a crystalline polyester resin has excellent low-temperature fixability.

However, the toner containing a crystalline polyester resin has insufficient heat resistance. Therefore, in the toner containing a crystalline polyester resin, soft caking is likely to occur under high temperature. The toner in which soft caking occurred has low fluidity, and therefore, conveyance failure of a developer occurs in an image forming apparatus.

In addition, a crystalline polyester resin has high hygroscopicity. Therefore, the electric charge amount of the toner is likely to decrease, and the scattering amount decreases in the image forming apparatus.

In this manner, the toner containing a crystalline polyester resin hardly maintains low-temperature fixability, fluidity, and scattering amount at the same time.

The use of an external additive is effective in improvement of the heat resistance and maintenance of the electric charge amount of a toner. However, when the toner is reused, the toner from which the external additive is detached is resupplied to a developing device in some cases. Therefore, when the toner is reused, improvement of the heat resistance and maintenance of the electric charge amount are much less likely to be achieved.

On the other hand, if the electric charge amount of a toner is too high, insufficient transfer of the toner occurs when forming an image. As a result, the image density may decrease.

DETAILED DESCRIPTION

Figure 1:
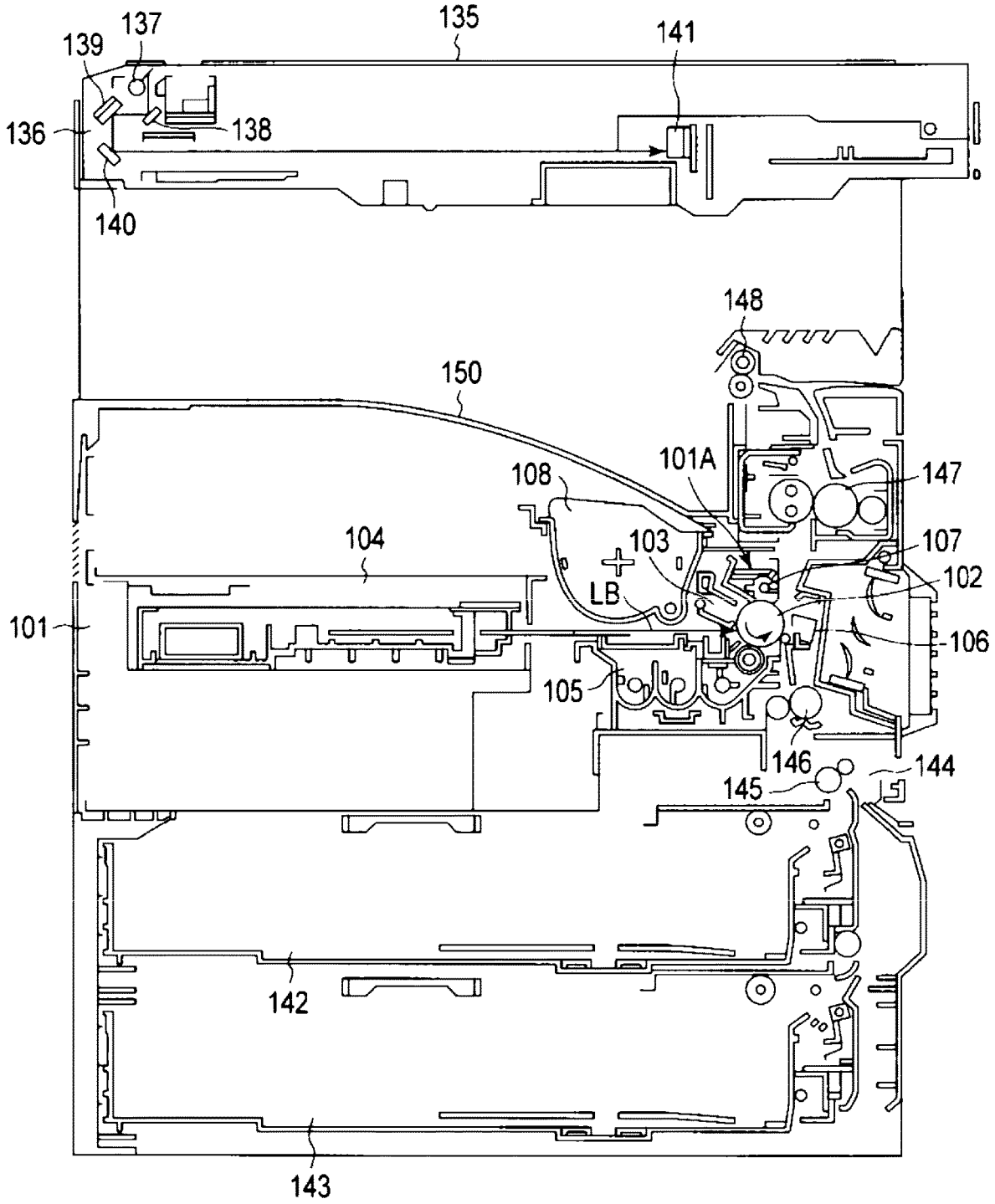
FIG. 1 is a diagram showing an example of a schematic structure of an image forming apparatus of an embodiment.

An object to be achieved by embodiments is to provide a toner which has excellent low-temperature fixability, and also has excellent heat resistance even when the toner is reused, sufficiently maintains an electric charge amount, and hardly decreases an image density. Also provided are a toner cartridge and an image forming apparatus, in each of which the toner is stored.

A toner according to an embodiment contains toner base particles and an external additive. The external additive is attached to surfaces of the toner base particles. The toner base particles contain a crystalline polyester resin and an ester wax.

The ester wax is a condensation polymer of a first monomer group and a second monomer group. The first monomer group comprises at least three or more types of carboxylic acids. The second monomer group comprises at least three or more types of alcohols.

The proportion of a carboxylic acid with a carbon number of $C_n$ is between 70 and 95 mass % with respect to 100 mass % of the first monomer group. The carbon number $C_n$ is the carbon number of a carboxylic acid, the content of which is highest in the first monomer group. The proportion of a carboxylic acid with a carbon number of 18 or less in the first monomer group is 5 mass % or less with respect to 100 mass % of the first monomer group.

The proportion of an alcohol with a carbon number of $C_m$ is between 70 and 90 mass % with respect to 100 mass % of the second monomer group. The carbon number $C_m$ is the carbon number of an alcohol, the content of which is highest in the second monomer group. The proportion of an alcohol with a carbon number of 18 or less in the second monomer group is 20 mass % or less with respect to 100 mass % of the second monomer group.

The external additive contains silica particles A, silica particles B, and silica particles C. The particle diameter $r_A$ of the silica particles A is between 10 and 14 nm. The particle diameter $r_B$ of the silica particles B is between 40 and 70 nm. The particle diameter $r_C$ of the silica particles C is between 90 and 150 nm.

The content of the silica particles A is between 0.1 and 0.8 parts by mass with respect to 100 parts by mass of the toner base particles.

The content of the silica particles B is between 0.3 and 1.2 parts by mass with respect to 100 parts by mass of the toner base particles.

The content of the silica particles C is between 0.3 and 1.2 parts by mass with respect to 100 parts by mass of the toner base particles.

The sum of the content of the silica particles A, the content of the silica particles B, and the content of the silica particles C is 3.0 parts by mass or less with respect to 100 parts by mass of the toner base particles.

The ratio of the content of the silica particles B to the content of the silica particles A is between 1.0 and 5.0.

The ratio of the content of the silica particles C to the content of the silica particles A is between 1.0 and 5.0.

The volume average primary particle diameter $D_{50}$ of the toner is between 5.5 and 11.0 μm.

Hereinafter, the toner according to the embodiment is described.

The toner according to the embodiment includes toner base particles and an external additive.

The toner base particles is described.

The toner base particles of the embodiment contain a crystalline polyester resin and an ester wax. The toner base particles of the embodiment may further contain another binder resin other than the crystalline polyester resin, and a colorant in addition to the crystalline polyester resin and the ester wax. The toner base particles of the embodiment may further contain another component other than the crystalline polyester resin, the ester wax, the another binder resin, and the colorant as long as the effect disclosed in the embodiment is obtained.

The crystalline polyester resin is described.

The crystalline polyester resin functions as a binder resin. Since the toner base particles contain a crystalline polyester resin, the toner of the embodiment has excellent low-temperature fixability.

In the embodiment, a polyester resin in which the ratio of the softening temperature to the melting temperature (softening temperature/melting temperature) is between 0.8 and 1.2 is defined as a "crystalline polyester resin". Further, a polyester resin in which the ratio of the softening temperature to the melting temperature (softening temperature/melting temperature) is less than 0.8 or more than 1.2 is defined as an "amorphous polyester resin".

An example of the crystalline polyester resin includes a condensation polymer of a dihydric or higher hydric alcohol and a divalent or higher valent carboxylic acid.

Examples of the dihydric or higher hydric alcohol include ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, and trimethylolpropane. As the dihydric or higher hydric alcohol, 1,4-butanediol or 1,6-hexanediol is preferred.

Examples of the divalent or higher valent carboxylic acid include adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, succinic acid substituted with an alkyl group or an alkenyl group, cyclohexane dicarboxylic acid, trimellitic acid, pyromellitic acid, acid anhydrides thereof, and esters thereof.

Examples of the succinic acid substituted with an alkyl group or an alkenyl group include succinic acid substituted with an alkyl group or an alkenyl group having 2 to 20 carbon atoms. For example, n-dodecenyl succinic acid, n-dodecyl succinic acid, and the like are exemplified. As the divalent or higher valent carboxylic acid, fumaric acid is preferred.

However, the crystalline polyester resin is not limited to the condensation polymer of a dihydric or higher hydric alcohol and a divalent or higher valent carboxylic acid exemplified here. As the crystalline polyester resin, anyone type may be used by itself or two or more types may be used in combination.

The mass average molecular weight of the crystalline polyester resin is preferably between $6\times10^3$ and $18\times10^3$, and more preferably between $8\times10^3$ and $14\times10^3$. When the mass average molecular weight of the crystalline polyester resin is the above lower limit or more, the toner has more excellent low-temperature fixability. In addition, when the mass average molecular weight of the crystalline polyester resin is the above upper limit or less, the toner also has excellent offset resistance.

The mass average molecular weight as used herein is a value in terms of polystyrene measured by gel permeation chromatography.

The melting point of the crystalline polyester resin is preferably between 60 and 120° C., more preferably between 70 and 115° C., and further more preferably between 80 and 110° C. When the melting point of the crystalline polyester resin is the above lower limit or higher, the toner has more excellent heat resistance. When the melting point of the crystalline polyester resin is the above upper limit or lower, the toner has more excellent low-temperature fixability.

The melting point of the crystalline polyester resin can be measured by, for example, a differential scanning calorimeter (DSC).

The another binder resin is described.

Examples of the another binder resin include an amorphous polyester resin, a styrenic resin, an ethylenic resin, an acrylic resin, a phenolic resin, an epoxy-based resin, an allyl phthalate-based resin, a polyamide-based resin, and a maleic acid-based resin. However, the another binder resin is not limited to these examples.

As the another binder resin, any one type may be used by itself or two or more types may be used in combination.

As the another binder resin, an amorphous polyester resin is preferred from the viewpoint that the effect disclosed in the embodiment is easily obtained. As the amorphous polyester resin, for example, a condensation polymer of a divalent or higher valent carboxylic acid and a dihydric alcohol is exemplified.

Examples of the divalent or higher valent carboxylic acid include a divalent or higher valent carboxylic acid, an acid anhydride of a divalent or higher valent carboxylic acid, and an ester of a divalent or higher valent carboxylic acid. Examples of the ester of a divalent or higher valent carboxylic acid include a lower alkyl (having 1 to 12 carbon atoms) ester of a divalent or higher valent carboxylic acid.

Examples of the dihydric alcohol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, and an alkylene oxide adduct of bisphenol A. However, the dihydric alcohol is not limited to these examples.

Examples of the alkylene oxide adduct of bisphenol A include a compound obtained by adding 1 to 10 moles on the average of an alkylene oxide having 2 to 3 carbon atoms to bisphenol A. Examples of the alkylene oxide adduct of bisphenol A include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane.

For the dihydric alcohol, an alkylene oxide adduct of bisphenol A is preferred. For the dihydric alcohol, any one type may be used by itself or two or more types may be used in combination.

The another binder resin is obtained by, for example, polymerizing a vinyl polymerizable monomer by itself or a plurality of types of vinyl polymerizable monomers.

Examples of the vinyl polymerizable monomer include an aromatic vinyl monomer, an ester-based monomer, a carboxylic acid-containing monomer, and an amine-based monomer.

Examples of the aromatic vinyl monomer include styrene, methylstyrene, methoxystyrene, phenylstyrene, chlorostyrene, and derivatives thereof.

Examples of the ester-based monomer include methyl acrylate, ethyl acrylate, butyl acrylate, methyl methacrylate, ethyl methacrylate, butyl methacrylate, and derivatives thereof.

Examples of the carboxylic acid-containing monomer include acrylic acid, methacrylic acid, fumaric acid, maleic acid, and derivatives thereof.

Examples of the amine-based monomer include amino acrylate, acrylamide, methacrylamide, vinylpyridine, vinylpyrrolidone, and derivatives thereof.

The another binder resin may be obtained by polycondensation of a polymerizable monomer component composed of an alcohol component and a carboxylic acid component. In the polycondensation of the polymerizable monomer component, various auxiliary agents such as a chain transfer agent, a crosslinking agent, a polymerization initiator, a surfactant, an aggregating agent, a pH adjusting agent, and an anti-foaming agent may be used.

The ester wax is described.

The ester wax of the embodiment comprises two or more types of ester compounds with a different carbon number. Since the toner base particles contain the ester wax, the toner has excellent heat resistance.

The ester wax is a condensation polymer of a first monomer group and a second monomer group.

The first monomer group is described.

The first monomer group comprises at least three or more types of carboxylic acids. The number of types of carboxylic acids in the first monomer group is preferably 7 types or less, and more preferably 5 types or less from the viewpoint that the ester wax is easy to obtain.

Here, the carbon number of a carboxylic acid, the content of which is highest in the first monomer group, is denoted by $C_n$. The carbon number $C_n$ is preferably between 19 and 28, more preferably between 19 and 24, and further more preferably between 20 and 24. When the carbon number $C_n$ is the above lower limit or more, the heat resistance of the ester wax is further improved. When the carbon number $C_n$ is the above upper limit or less, the toner has more excellent low-temperature fixability.

The proportion of the carboxylic acid with a carbon number of $C_n$, the content of which is highest, is between 70 and 95 mass %, preferably between 80 and 95 mass %, and more preferably between 85 and 95 mass % with respect to 100 mass % of the first monomer group. Since the proportion of the carboxylic acid with a carbon number of $C_n$ is the above lower limit or more, the maximum peak of the carbon number distribution of the ester wax is located sufficiently on the high carbon number side. As a result, the toner has excellent heat resistance. Since the proportion of the carboxylic acid with a carbon number of $C_n$ is the above upper limit or less, the ester wax is easy to obtain.

The proportion of a carboxylic acid with a carbon number of 18 or less in the first monomer group is 5 mass % or less, preferably between 0 and 5 mass %, and more preferably between 0 and 1 mass % with respect to 100 mass % of the first monomer group. When the proportion of the carboxylic acid with a carbon number of 18 or less is the above lower limit or more, the ester wax is easy to obtain. Since the proportion of the carboxylic acid with a carbon number of 18 or less is the above upper limit or less, the proportion of an ester compound having a relatively low molecular weight in the ester wax becomes small. As a result, the toner has excellent heat resistance.

The content of each of the carboxylic acids with the corresponding carbon number in the first monomer group can be measured by, for example, performing mass spectrometry using FD-MS (field desorption mass spectrometry) for a product after a methanolysis reaction of the ester wax. The total ionic strength of the carboxylic acids with the corresponding carbon number in the product obtained by the measurement using FD-MS is assumed to be 100. The relative value of the ionic strength of each of the carboxylic acids with the corresponding carbon number with respect to the total ionic strength is calculated. The calculated relative value is defined as the content of each of the carboxylic acids with the corresponding carbon number in the first monomer group. Further, the carbon number of the carboxylic acid with a carbon number, the relative value of which is highest, is denoted by $C_n$.

As the carboxylic acid in the first monomer group, a long-chain carboxylic acid is preferred from the viewpoint that the ester wax is easy to obtain, and a long-chain alkyl carboxylic acid is more preferred. The long-chain carboxylic acid is appropriately selected so that the ester wax meets the predetermined requirements.

The long-chain carboxylic acid is preferably a long-chain carboxylic acid with a carbon number of 19 to 28, and more preferably a long-chain carboxylic acid with a carbon number of 20 to 24. When the carbon number of the long-chain carboxylic acid is the above lower limit or more, the heat resistance of the ester wax is further improved. When the carbon number of the long-chain carboxylic acid is the above upper limit or less, the toner has more excellent low-temperature fixability.

Examples of the long-chain alkyl carboxylic acid include palmitic acid, stearic acid, arachidonic acid, behenic acid, lignoceric acid, cerotic acid, and montanic acid.

The second monomer group is described.

The second monomer group comprises at least three or more types of alcohols. The number of types of alcohols in the second monomer group is preferably 5 types or less from the viewpoint that the ester wax is easy to obtain.

Here, the carbon number of an alcohol, the content of which is highest in the second monomer group, is denoted by $C_m$. The carbon number $C_m$ is preferably between 19 and 28, more preferably between 20 and 24, and further more preferably between 20 and 22. When the carbon number $C_m$ is the above lower limit or more, the heat resistance of the ester wax is improved. When the carbon number $C_m$ is the above upper limit or less, the toner has excellent low-temperature fixability.

The proportion of the alcohol with a carbon number of $C_m$, the content of which is highest, is between 70 and 90 mass %, preferably between 80 and 90 mass %, and more preferably between 85 and 90 mass % with respect to 100 mass % of the second monomer group. Since the proportion of the alcohol with a carbon number of $C_m$ is the above lower limit or more, the maximum peak of the carbon number distribution of the ester wax is located sufficiently on the high carbon number side. As a result, the toner has excellent heat resistance. When the proportion of the alcohol with a carbon number of $C_m$ is the above upper limit or less, the ester wax is easy to obtain.

The proportion of an alcohol with a carbon number of 18 or less in the second monomer group is 20 mass % or less, preferably between 10 and 20 mass %, and more preferably between 15 and 20 mass % with respect to 100 mass % of the second monomer group. When the proportion of the alcohol with a carbon number of 18 or less is the above lower limit or more, the ester wax is easy to obtain. Since the proportion of the alcohol with a carbon number of 18 or less is the above upper limit or less, the proportion of an ester compound having a relatively low molecular weight in the ester wax becomes small. As a result, the toner has excellent heat resistance.

The content of each of the alcohols with the corresponding carbon number in the second monomer group can be measured by, for example, performing mass spectrometry using FD-MS for a product after a methanolysis reaction of the ester wax. The total ionic strength of the alcohols with the corresponding carbon number in the product obtained by the measurement using FD-MS is assumed to be 100. The relative value of the ionic strength of each of the alcohols with the corresponding carbon number with respect to the total ionic strength is calculated. The calculated relative value is defined as the content of each of the alcohols with the corresponding carbon number in the second monomer group. Further, the carbon number of the alcohol with a carbon number, the relative value of which is highest, is denoted by $C_m$.

For the alcohol in the second monomer group, a long-chain alcohol is preferred from the viewpoint that the ester wax is easy to obtain, and a long-chain alkyl alcohol is more preferred. The long-chain alcohol is appropriately selected so that the ester wax meets the predetermined requirements. The long-chain alcohol is preferably a long-chain alcohol with a carbon number of 19 to 28, and more preferably a long-chain alcohol with a carbon number of 20 to 22. When the carbon number of the long-chain alcohol is the above lower limit or more, the heat resistance of the ester wax is improved, and the toner has more excellent heat resistance. When the carbon number of the long-chain alcohol is the above upper limit or less, the toner has more excellent low-temperature fixability.

Examples of the long-chain alkyl alcohol include palmityl alcohol, stearyl alcohol, arachidyl alcohol, behenyl alcohol, lignoceryl alcohol, ceryl alcohol, and montanyl alcohol.

In the ester wax of the embodiment, an ester compound with a carbon number of $C_1$, the content of which is highest among the ester compounds constituting the ester wax of the embodiment, is preferably present. The carbon number $C_1$ is preferably 43 or more, more preferably between 43 and 56, further more preferably between 43 and 52, particularly preferably between 44 and 46, and most preferably 44. When the carbon number $C_1$ is the above lower limit or more, the toner has more excellent heat resistance. When the carbon number $C_1$ is the above upper limit or less, the ester wax is easy to obtain.

The ester compound with a carbon number of $C_1$ is represented by the following formula (I).

$$R^1COOR^2 \quad (I)$$

In the formula (I), $R^1$ and $R^2$ are each an alkyl group. The total carbon number of $R^1$ and $R^2$ is preferably 42 or more, more preferably between 42 and 55, further more preferably between 42 and 51, particularly preferably between 43 and 45, and most preferably 43. When the total carbon number of $R^1$ and $R^2$ is the above lower limit or more, the toner has more excellent heat resistance. When the total carbon number of $R^1$ and $R^2$ is the above upper limit or less, the ester wax is easy to obtain. The carbon number of $R^1$ can be controlled by adjusting the carbon number $C_n$ of the carboxylic acid with a carbon number of $C_n$. The carbon number of $R^2$ can be controlled by adjusting the carbon number $C_m$ of the alcohol with a carbon number of $C_m$.

The proportion of the ester compound with a carbon number of $C_1$ is preferably 65 mass % or more, more preferably between 65 and 90 mass %, further more preferably between 70 and 90 mass %, and particularly preferably between 80 and 90 mass % with respect to 100 mass % of the ester wax. When the proportion of the ester compound with a carbon number of $C_1$ is the above lower limit or more, the maximum peak of the carbon number distribution of the ester wax becomes sufficiently high. As a result, the toner has more excellent heat resistance. When the proportion of the ester compound with a carbon number of $C_1$ is the above upper limit or less, the ester wax is easy to obtain.

The carbon number distribution of the ester wax of the embodiment preferably has only one maximum peak in a region where the carbon number is 43 or more. In that case, the proportion of an ester compound having a relatively low molecular weight becomes small. As a result, the toner has more excellent heat resistance.

In the carbon number distribution of the ester wax of the embodiment, the position of the maximum peak is preferably in a region where the carbon number is between 43 and 56, more preferably in a region where the carbon number is between 44 and 52, further more preferably in a region where the carbon number is between 44 and 46, and most preferably a position where the carbon number is 44. When the position of the maximum peak is in a region where the carbon number is the above lower limit or more, the toner has more excellent heat resistance. When the position of the maximum peak is in a region where the carbon number is the above upper limit or less, the ester wax is easy to obtain.

The content of each of the ester compounds with the corresponding carbon number in the ester wax can be measured by, for example, mass spectrometry using FD-MS. The total ionic strength of the ester compounds with the corresponding carbon number in the ester wax obtained by the measurement using FD-MS is assumed to be 100. The relative value of the ionic strength of each of the ester compounds with the corresponding carbon number with respect to the total ionic strength is calculated. The calculated relative value is defined as the content of each of the ester compounds with the corresponding carbon number in the ester wax. Further, the carbon number of the ester compound with a carbon number, the relative value of which is highest, is denoted by $C_1$.

A method for preparing the ester wax is described.

The ester wax can be prepared by, for example, subjecting a long-chain carboxylic acid and a long-chain alcohol to an esterification reaction. In the esterification reaction, at least three or more types of long-chain alkyl carboxylic acids and at least three or more types of long-chain alkyl alcohols are preferably used from the viewpoint that the ester wax that meets the predetermined requirements is easily obtained. When the used amount of each of the at least three types of long-chain alkyl carboxylic acids and the at least three types of long-chain alkyl alcohols is adjusted, the carbon number distribution of the ester compounds contained in the ester wax can be adjusted. The esterification reaction is preferably performed while heating under a nitrogen gas stream.

The esterification reaction product may be purified by being dissolved in a solvent containing ethanol, toluene, or the like, and further adding a basic aqueous solution such as a sodium hydroxide aqueous solution to separate the solution into an organic layer and an aqueous layer. By removing the aqueous layer, the ester wax can be obtained. The purification operation is preferably repeated a plurality of times.

The colorant is described.

The colorant is not particularly limited. Examples thereof include carbon black, cyan, yellow, and magenta-based pigments and dyes.

Examples of the carbon black include aniline black, lamp black, acetylene black, furnace black, thermal black, channel black, and Ketjen black.

Examples of the pigments and dyes include Fast Yellow G, benzidine yellow, chrome yellow, quinoline yellow, Indofast Orange, Irgazin Red, Carmine FB, Permanent Bordeaux FRR, Pigment Orange R, Lithol Red 2G, Lake Red C, Rhodamine FB, Rhodamine B Lake, Du Pont Oil Red, phthalocyanine blue, Pigment Blue, aniline blue, calcoil blue, ultramarine blue, brilliant green B, phthalocyanine green, malachite green oxalate, methylene blue chloride, rose bengal, and quinacridone.

Examples of the colorant include C.I. Pigment Black 1, 6, and 7, C.I. Pigment Yellow 1, 12, 14, 17, 34, 74, 83, 97, 155, 180, and 185, C.I. Pigment Orange 48 and 49, C.I. Pigment Red 5, 12, 31, 48, 48:1, 48:2, 48:3, 48:4, 48:5, 49, 53, 53:1, 53:2, 53:3, 57, 57:1, 81, 81:4, 122, 146, 150, 177, 185, 202, 206, 207, 209, 238, and 269, C.I. Pigment Blue 15, 15:1, 15:2, 15:3, 15:4, 15:5, 15:6, 75, 76, and 79, C.I. Pigment Green 1, 7, 8, 36, 42, and 58, C.I. Pigment Violet 1, 19, and 42, and C.I. Acid Red 52, each of which is indicated by the Color Index Number. However, the colorant is not limited to these examples.

As the colorant, any one type may be used by itself or two or more types may be used in combination.

The another component is described.

Examples of the another component include additives such as a charge control agent, a surfactant, a basic compound, an aggregating agent, a pH adjusting agent, and an antioxidant. However, the additive is not limited to these examples. As the additive, any one type may be used by itself or two or more types may be used in combination.

The charge control agent is described.

When the toner base particles contain the charge control agent, the toner is easily transferred onto a recording medium such as paper. Examples of the charge control agent include a metal-containing azo compound, a metal-containing salicylic acid derivative compound, a hydrophobized metal oxide, and a polysaccharide inclusion compound. As the metal-containing azo compound, a complex or a complex salt in which the metal is iron, cobalt, or chromium, or a mixture thereof is preferred. As the metal-containing salicylic acid derivative compound and the hydrophobized metal oxide, a complex or a complex salt in which the metal is zirconium, zinc, chromium, or boron, or a mixture thereof is preferred. As the polysaccharide inclusion compound, a polysaccharide inclusion compound containing aluminum (Al) and magnesium (Mg) is preferred.

The composition of the toner base particles is described.

The content of the crystalline polyester resin is preferably between 5 and 25 mass %, more preferably between 5 and 20 mass %, and further more preferably between 5 and 15 mass % with respect to 100 mass % of the toner base particles. When the content of the crystalline polyester resin is the above lower limit or more, the toner has more excellent low-temperature fixability. When the content of the crystalline polyester resin is the above upper limit or less, the toner has excellent offset resistance.

The content of the ester wax is preferably between 3 and 15 mass %, more preferably between 3 and 13 mass %, and further more preferably between 5 and 10 mass % with respect to 100 mass % of the toner base particles. When the content of the ester wax is the above lower limit or more, the toner has more excellent heat resistance. Further, when the content of the ester wax is the above upper limit or less, the toner has more excellent low-temperature fixability, and the electric charge amount is likely to be sufficiently maintained.

When the toner base particles contain an amorphous polyester resin, the content of the amorphous polyester resin is preferably between 60 and 90 mass %, more preferably between 65 and 85 mass %, and further more preferably between 70 and 80 mass % with respect to 100 mass % of the toner base particles. When the content of the amorphous polyester resin is the above lower limit or more, the toner has excellent offset resistance. Further, when the content of the amorphous polyester resin is the above upper limit or less, the toner has more excellent low-temperature fixability.

When the toner base particles contain a colorant, the content of the colorant is preferably between 2 and 13 mass %, and more preferably between 3 and 8 mass % with respect to 100 mass % of the toner base particles. When the content of the colorant is the above lower limit or more, the toner has excellent color reproducibility. Further, when the content of the colorant is the above upper limit or less, the dispersibility of the colorant is excellent and the toner has more excellent low-temperature fixability. In addition, the electric charge amount of the toner is easily controlled.

The external additive is described.

The external additive contains specific silica particles A, silica particles B, and silica particles C. The particle diameter $r_A$ of the silica particles A is between 10 and 14 nm. The particle diameter $r_B$ of the silica particles B is between 40 and 70 nm. The particle diameter $r_C$ of the silica particles C is between 90 and 150 nm.

In this manner, the toner of the embodiment contains the silica particles A, the silica particles B, and the silica particles C having mutually different particle diameters. Therefore, when the external additive is taken out from the toner of the embodiment and a particle size distribution is obtained by measuring the particle diameter of the external additive, at least three maximum peaks of silica particles are considered to be present.

In the particle size distribution, among the at least three maximum peaks, at least one maximum peak is preferably present in each of the ranges from 10 to 14 nm, from 40 to 70 nm, and from 90 to 150 nm. In that case, the particle diameter $r_A$ can be set to a mode value (most frequently occurring value) within the range from 10 to 14 nm in the particle size distribution. Further, the particle diameter $r_B$ can be set to a mode value (most frequently occurring value) within the range from 40 to 70 nm in the particle size distribution. In addition, the particle diameter $r_C$ can be set to a mode value (most frequently occurring value) within the range from 90 to 150 nm in the particle size distribution.

The particle diameters of the respective silica particles can be measured using, for example, a laser diffraction particle size distribution analyzer.

The particle diameter $r_A$ of the silica particles A is relatively small. Therefore, the fluidity and chargeability of the toner are improved by the silica particles A. As a result, even when the toner of the embodiment is reused, the toner has excellent heat resistance and sufficiently maintains an electric charge amount.

However, the silica particles A are likely to be detached from the surface of the toner and also are likely to be embedded when the surfaces of the toner base particles receive stress in a developing device. Therefore, the silica particles Aare protected from stress by the silica particles C having a relatively large particle diameter $r_C$.

Meanwhile, silica having a large particle diameter generally has a low charge imparting ability. Therefore, by the presence of the silica particles C, the charge imparting ability of the silica particles A is deteriorated, and the electric charge amount may decrease. In view of this, by the silica particles B having a medium particle diameter $r_B$ in addition to the silica particles C, the silica particles A are protected from stress. At the same time, by the silica particles B, the electric charge amount and the toner scattering amount are sufficiently maintained.

The contents of the silica particles A, the silica particles B, and the silica particles C are within specific ranges, respectively. Therefore, the toner of the embodiment has excellent heat resistance even when the toner is reused, sufficiently maintains an electric charge amount, and also hardly decreases an image density.

The particle diameter $r_A$ is between 10 and 14 nm, preferably between 11 and 13 nm, and more preferably between 11 and 12 nm. Since the particle diameter $r_A$ is the above lower limit or more, the electric charge amount of the toner of the embodiment becomes high, and the scattering amount of the toner is sufficiently maintained. Since the particle diameter $r_A$ is the above upper limit or less, the silica particles A are less likely to be embedded in the toner base particles. Therefore, the fluidity of the toner is improved. As a result, the scattering amount of the toner is also sufficiently maintained.

The particle diameter $r_B$ is between 40 and 70 nm, preferably between 45 and 65 nm, and more preferably between 50 and 60 nm. Since the particle diameter $r_B$is the above lower limit or more, the silica particles B can sufficiently protect the silica particles A. Therefore, the silica particles Aare less likely to be detached, so that fluidity is sufficiently exhibited and conveyance failure is reduced. Since the particle diameter $r_B$ is the above upper limit or less, the electric charge amount of the toner is sufficiently maintained, and the scattering amount of the toner is also sufficiently maintained.

The particle diameter $r_C$ is between 90 and 150 nm, preferably between 100 and 140 nm, and more preferably between 115 and 130 nm. Since the particle diameter $r_C$ is the above lower limit or more, the silica particles C can sufficiently protect the silica particles A. Therefore, the silica particles A are less likely to be detached, so that fluidity is sufficiently exhibited and conveyance failure is reduced. Since the particle diameter $r_C$ is the above upper limit or less, the electric charge amount and the scattering amount of the toner are less likely to decrease.

The content $w_A$ of the silica particles A is between 0.1 and 0.8 parts by mass, preferably between 0.3 and 0.6 parts by mass, and more preferably between 0.4 and 0.5 parts by mass with respect to 100 parts by mass of the toner base particles. Since the content $w_A$ of the silica particles A is the above lower limit or more, the electric charge amount of the toner of the embodiment becomes sufficiently high, and the scattering amount of the toner is sufficiently maintained. Further, even when the toner is reused, the toner has favorable fluidity, and the conveyance failure is reduced. Since the content $w_A$ of the silica particles A is the above upper limit or less, the electric charge amount of the toner does not become too high. Therefore, the image density is sufficiently ensured when forming an image, and the image density is less likely to decrease.

The content $w_B$ of the silica particles B is between 0.3 and 1.2 parts by mass, preferably between 0.5 and 1.0 parts by mass, and more preferably between 0.7 and 0.9 parts by mass with respect to 100 parts by mass of the toner base particles. Since the content $w_B$ of the silica particles B is the above lower limit or more, the electric charge amount of the toner becomes high, and the scattering amount of the toner is sufficiently maintained. Since the content $w_B$ of the silica particles B is the above upper limit or less, the electric charge amount of the toner is sufficiently maintained, and the scattering amount of the toner is also sufficiently maintained.

The content $w_C$ of the silica particles C is between 0.3 and 1.2 parts by mass, preferably between 0.5 and 1.0 parts by mass, and more preferably between 0.7 and 0.8 parts by mass with respect to 100 parts by mass of the toner base particles. Since the content $w_C$ of the silica particles C is the above lower limit or more, the silica particles A are less likely to be detached, so that fluidity is sufficiently exhibited and conveyance failure is reduced. Since the content $w_C$ of the silica particles C is the above upper limit or less, the electric charge amount and the scattering amount of the toner of the embodiment are less likely to decrease.

The sum $w_{A+B+C}$ of the content of the silica particles A, the content of the silica particles B, and the content of the silica particles C is 3.0 parts by mass or less, preferably between 1 and 3 parts by mass, and more preferably between 1.8 and 2.4 parts by mass with respect to 100 parts by mass of the toner base particles. When the sum $w_{A+B+C}$ of the contents is the above lower limit or more, the toner base particles are protected by the external additive during storage, and the toner also has excellent storage stability. Since the sum $w_{A+B+C}$ of the contents is the above upper limit or less, the toner is sufficiently melted when fixing, and the low-temperature fixability is improved.

The ratio (B/A) of the content of the silica particles B to the content of the silica particles A is between 1.0 and 5.0, preferably between 2.0 and 4.5, and more preferably between 3.0 and 4.0. Since the ratio (B/A) is the above lower limit or more, the silica particles A are less likely to be detached, so that fluidity is sufficiently exhibited and conveyance failure is reduced. Since the ratio (B/A) is the above upper limit or less, the electric charge amount of the toner is sufficiently maintained, and the scattering amount of the toner is also sufficiently maintained.

The ratio (C/A) of the content of the silica particles C to the content of the silica particles A is between 1.0 and 5.0, preferably between 1.5 and 4.0, and more preferably between 2.0 and 3.0. Since the ratio (C/A) is the above lower limit or more, the silica particles A are less likely to be detached, so that fluidity is sufficiently exhibited and conveyance failure is reduced. Since the ratio (C/A) is the above upper limit or less, the electric charge amount and the scattering amount of the toner of the embodiment are less likely to decrease.

The silica particles A, B, and C are preferably all primary particles of silica. The primary particles of silica are attached to the surfaces of the toner base particles in a monodispersed state. Therefore, the control of the electric charge amount of the toner is easy, and the decrease in scattering amount and the decrease in image density become smaller. Here, the primary particle of silica means one particle composed of silica. The primary particle of silica has preferably a spherical shape, and more preferably a true spherical shape.

As the external additive, secondary particles of silica may be present on the surfaces of the toner base particles in addition to the primary particles of silica as long as the effect disclosed in the embodiment is obtained. The secondary particle of silica is a joined material in which two or more primary particles of silica are joined together. Therefore, the secondary particle has an indefinite shape. A specific shape of the secondary particle is not particularly limited. The shape of the secondary particle may be a polygonal prism shape, or a polyhedron shape, or an elliptical shape.

As the silica particles A, B, and C, wet silica is preferred from the viewpoint that the electric charge amount of the toner is more sufficiently maintained. The wet silica can be produced by, for example, a method (liquid phase method) in which sodium silicate made from silica sand is used as a raw material, and an aqueous solution containing sodium silicate is neutralized to deposit silica, and the silica is filtered and dried. On the other hand, fumed silica (dry silica) obtained by reacting silicon tetrachloride in a flame at high temperature is known. When wet silica is used as the external additive of the toner, the electric charge amount of the toner is generally easily maintained as compared with fumed silica having a low moisture content.

As the silica particles A, B, and C, hydrophobic silica particles are preferred, respectively, from the viewpoint that the toner has more excellent heat resistance. The hydrophobic silica particles are obtained by, for example, hydrophobizing a surface silanol group of wet silica with silane, silicone, or the like. When the hydrophobic silica particles are used as the external additive of the toner, the adhesiveness thereof to the toner base particles is enhanced.

The degree of hydrophobization of the hydrophobic silica can be measured by, for example, the following method.

50 mL of ion exchanged water and 0.2 g of a sample are placed in a beaker, and methanol is added dropwise thereto from a burette while stirring using a magnetic stirrer. Then, a powder gradually precipitates as the concentration of methanol in the beaker increases, and the volume percent of methanol in the mixed solution of methanol and ion exchanged water at the end point when the total amount thereof precipitated is defined as the degree of hydrophobization (%).

The external additive may further contain another inorganic oxide other than the silica particles. Examples of the another inorganic oxide include strontium titanate, titanium oxide, alumina, and tin oxide.

The silica particles and particles comprising an inorganic oxide may be subjected to a surface treatment with a hydrophobizing agent from the viewpoint of improving the stability. As the inorganic oxide, any one type may be used by itself or two or more types may be used in combination.

The volume average primary particle diameter $D_{50}$ of the toner of the embodiment is between 5.5 and 11.0 μm, preferably between 5.8 and 10.0 μm, and more preferably between 6.0 and 8.0 μm. Since the volume average primary particle diameter $D_{50}$ the toner is the above lower limit or more, the fluidity of the toner is improved. Therefore, even when the toner is reused, conveyance failure of the toner is less likely to occur. Since the volume average primary particle diameter $D_{50}$ of the toner is the above upper limit or less, the image density is less likely to decrease.

A method for producing the toner is described.

The toner of the embodiment can be produced by mixing the toner base particles and the external additive. By mixing the toner base particles and the external additive, the external additive is adhered to the surfaces of the toner base particles.

The toner base particles of the embodiment can be produced by, for example, a kneading and pulverization method or a chemical method.

The kneading and pulverization method is described.

As the kneading and pulverization method, for example, a production method including the following mixing step, kneading step, and pulverization step is exemplified. The kneading and pulverization method may further include the following classification step as needed.

- a mixing step: a step of mixing at least a crystalline polyester resin and an ester wax, thereby obtaining a mixture
- a kneading step: a step of melt-kneading the mixture, thereby obtaining a kneaded material
- a pulverization step: a step of pulverizing the kneaded material, thereby obtaining a pulverized material
- a classification step: a step of classifying the pulverized material In the mixing step, the raw materials of the toner are mixed, thereby obtaining a mixture. In the mixing step, a mixer may be used. The mixer is not particularly limited. In the mixing step, a colorant, another binder resin, or an additive may be used as needed.

In the kneading step, the mixture obtained in the mixing step is melt-kneaded, thereby obtaining a kneaded material. In the kneading step, a kneader may be used. The kneader is not particularly limited.

In the pulverization step, the kneaded material obtained in the kneading step is pulverized, thereby obtaining a pulverized material. In the pulverization step, a pulverizer may be used. As the pulverizer, various pulverizers such as a hammer mill can be used. In addition, the pulverized material obtained using a pulverizer may be further finely pulverized. As a pulverizer used for further finely pulverizing the pulverized material, various pulverizers can be used. The pulverized material obtained in the pulverization step may be directly used as the toner base particles, or may be subjected to the classification step as needed and used as the toner base particles.

In the classification step, the pulverized material obtained in the pulverization step is classified. In the classification step, a classifier may be used. The classifier is not particularly limited.

The chemical method is described.

In the chemical method, a crystalline polyester resin, an ester wax, and according to need, another binder resin or an additive are mixed, thereby obtaining a mixture. Subsequently, the mixture is melt-kneaded, thereby obtaining a kneaded material. Subsequently, the kneaded material is pulverized, thereby obtaining coarsely granulated moderately pulverized particles. Subsequently, the moderately pulverized particles are mixed with an aqueous medium, thereby preparing a mixed liquid. Subsequently, the mixed liquid is subjected to mechanical shearing, thereby obtaining a fine particle dispersion liquid. Finally, the fine particles are aggregated in the fine particle dispersion liquid, thereby forming toner base particles.

A method for adding the external additive is described.

The external additive is mixed with the toner base particles using, for example, a mixer. The mixer is not particularly limited.

The external additive may be sieved using a sieving device as needed. The sieving device is not particularly limited. Various sieving devices can be used.

A toner cartridge of an embodiment is described.

In the toner cartridge of the embodiment, the toner of the embodiment described above is stored. For example, the toner cartridge includes a container, and the toner of the embodiment is stored in the container. The container is not particularly limited, and various containers that can be applied to an image forming apparatus can be used.

The toner of the embodiment may be used as a one-component developer or may be combined with a carrier and used as a two-component developer.

Hereinafter, an image forming apparatus of an embodiment is described with reference to the drawing. FIG. 1 is a diagram showing an example of a schematic structure of an image forming apparatus capable of reusing a recovered toner.

A copier body 101 shown in FIG. 1 includes an image forming section 101A provided in a central one side part, an original document placing table 135 provided in an upper face part, a scanner 136 provided at a lower side of the original document placing table 135, and multiple stages of paper feed cassettes 142 and 143 provided at a lower side.

The image forming section 101A includes a photoconductive drum 102 which is rotatable in the arrow direction, an electrostatic charger 103 configured to charge the surface of the photoconductive drum 102, a laser unit 104 configured to form an electrostatic latent image on the surface of the photoconductive drum 102, a developing device 105 configured to develop the electrostatic latent image on the photoconductive drum 102 with a toner, a transfer charger 106 configured to transfer the toner image on the photoconductive drum 102 to paper, a cleaning device 107 configured to remove the residual toner on the photoconductive drum 102, and a replenishment container 108 provided in an upper part of the developing device 105.

The electrostatic charger 103, the laser unit 104, the developing device 105, the transfer charger 106, and the cleaning device 107 are provided around the photoconductive drum 102 in this order along the rotational direction of the photoconductive drum 102.

The replenishment container 108 replenishes the toner of the embodiment to the developing device 105. In the replenishment container 108, the toner of the embodiment is stored.

The scanner 136 exposes an original document on the original document placing table 135 to light. The scanner 136 includes a light source 137 configured to irradiate the original document with light, a first reflection mirror 138 configured to reflect light reflected from the original document in a predetermined direction, a second reflection mirror 139 and a third reflection mirror 140 configured to sequentially reflect light reflected from the first reflection mirror 138, and a light receiving element 141 configured to receive light reflected from the third reflection mirror 140.

The paper feed cassettes 142 and 143 send out paper to the image forming section 101A. The paper is conveyed to an upper side trough a conveyance system 144. The conveyance system 144 includes a conveyance roller pair 145, a resist roller pair 146, the transfer charger 106, a fixing roller pair 147, and a paper discharge roller pair 148.

In the image forming apparatus shown in FIG. 1, for example, image formation is carried out as follows.

First, an original document on the original document placing table 135 is irradiated with light from the light source 137. The irradiated light is reflected from the original document, and sequentially passes through the first reflection mirror 138, the second reflection mirror 139, and the third reflection mirror 140, and is received by the light receiving element 141 so as to read an original document image. Subsequently, based on the information read by the light receiving element 141, the surface of the photoconductive drum 102 is irradiated with a laser beam LB from the laser unit 104.

Here, the surface of the photoconductive drum 102 is negatively charged by the electrostatic charger 103. When the laser beam LB is irradiated from the laser unit 104, the photoconductive drum 102 is exposed to light, and the potential of the irradiated portion approaches 0. Therefore, in a region corresponding to the image portion of the original document, the potential of the surface of the photoconductive drum 102 approaches 0 according to the density of the image, and thus, an electrostatic latent image is formed.

The electrostatic latent image is converted into a toner image by adsorbing the toner at a position facing the developing device 105 by the rotation of the photoconductive drum 102. When forming the toner image, paper is fed to the conveyance system 144 from the paper feed cassettes 142 and 143. The paper is aligned by the resist roller pair 146 and sent between the transfer charger 106 and the photoconductive drum 102. Thereafter, the toner image on the photoconductive drum 102 is transferred to the paper.

The paper to which the toner image is transferred is conveyed to the fixing roller pair 147. In the fixing roller pair 147, the paper is pressed and heated, whereby the toner image is fixed to the paper. The toner of the embodiment has excellent low-temperature fixability. Therefore, fixing can be carried out, for example, at about 140 to 170° C. After fixing, the paper is discharged onto a paper discharge dray 150 through the paper discharge roller pair 148.

On the other hand, the toner which is not transferred to the paper and remains on the surface of photoconductive drum 102 is removed by the cleaning device 107. Thereafter, the toner is returned to the developing device 105 by a recovery mechanism 110 and reused. Further, in the image forming apparatus shown in FIG. 1, when the toner in the developing device 150 is consumed, the toner of the embodiment is newly replenished from the replenishment container 108 as a fresh toner.

Figure 2:
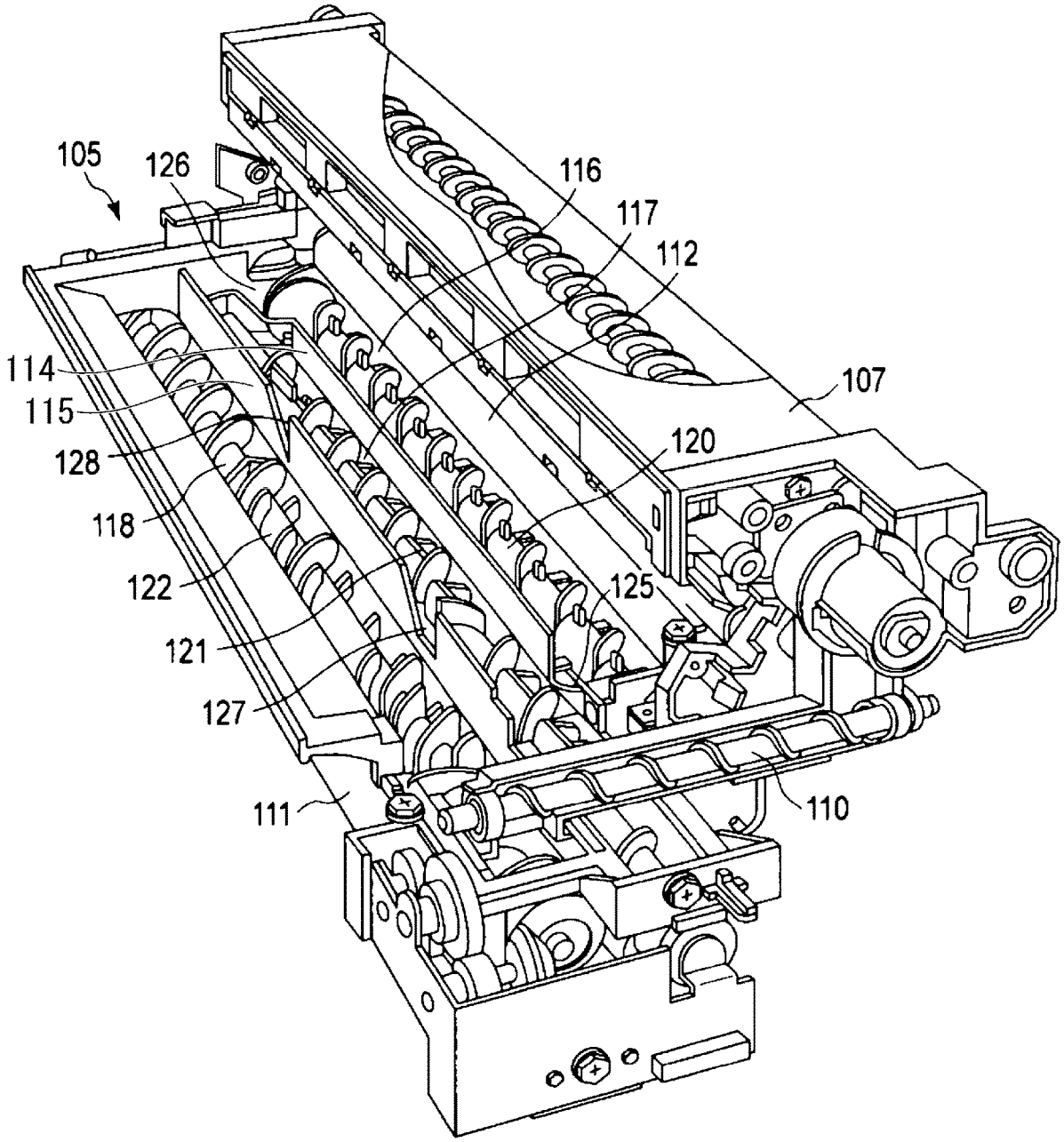
FIG. 2 is a perspective view of a developing device.
Figure 3:
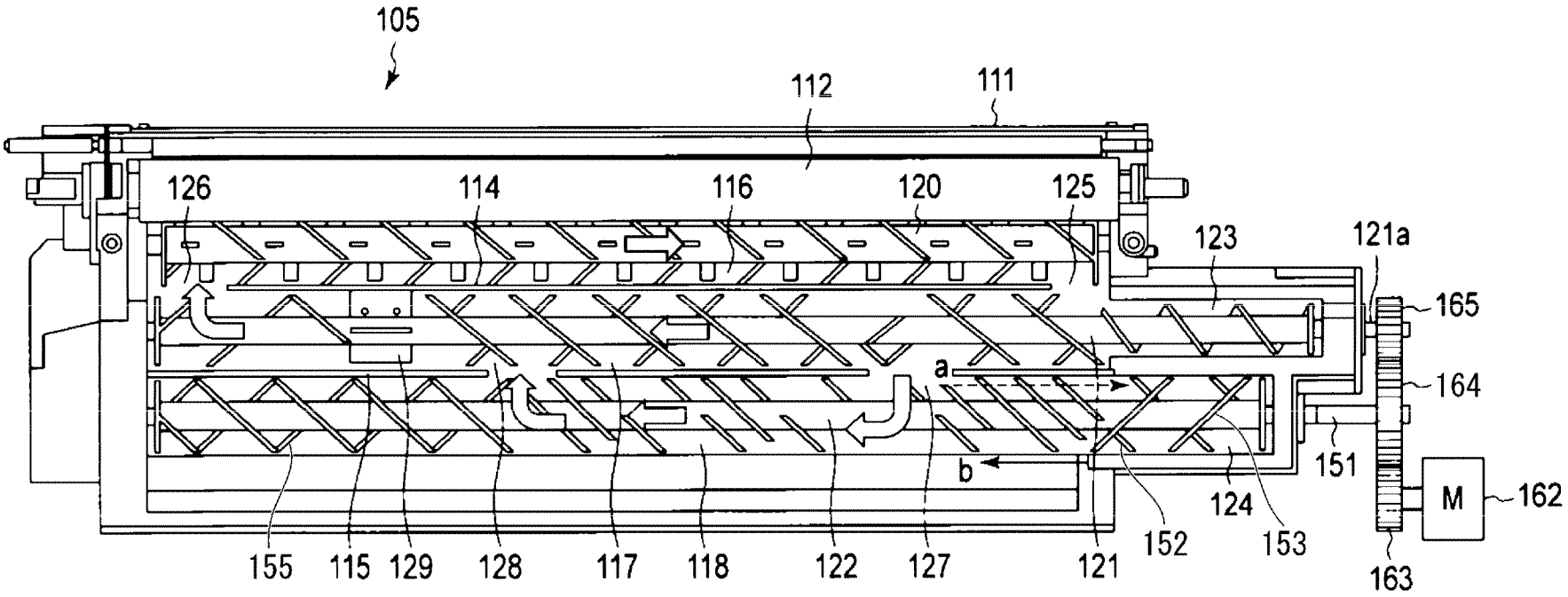
FIG. 3 is a side view of the developing device.

The developing device 105 is described with reference to FIGS. 2 and 3.

The developing device 105 includes a recovery mechanism 110 configured to recover a toner for reusing the toner, a development container 111 storing a developer containing the toner of the embodiment, a developing roller 112 provided rotatably in the development container 111, a first partition wall 114 and a second partition wall 115 configured to form a first chamber 116, a second chamber 117, and a third chamber 118 in the development container 111, a first mixer 120 provided in the first chamber 116, a second mixer 121 provided in the second chamber 117, a third mixer 122 provided in the third chamber 118, a fresh toner receiver 123 configured to receive a fresh toner supplied from the replenishment container, a recycled toner receiver 124, and a toner concentration detector 129.

The developing device 105 is connected to the cleaning device 107 through the recovery mechanism 110. In the developing device 105, the recovery mechanism 110 is an auger to which a toner to be reused is conveyed. However, the recovery mechanism 110 is not limited to the auger.

The cleaning device 107 may be a cleaning blade or a cleaning brush.

The developing roller 112 is disposed at a position facing a lower face part of the photoconductive drum 102. The developing roller 112 supplies a developer to the photoconductive drum 102 by rotation.

A first communication section 125 is formed at a first end part side of the first partition wall 114. Further, a second communication section 126 is formed at a second end part side of the first partition wall 114. Further, a third communication section 127 and a fourth communication section 128 are each formed in the second partition wall 115.

In the development container 111, the first chamber 116, the second chamber 117, and the third chamber 118 are divided by the first partition wall 114 and the second partition wall 115. The first chamber 116, the second chamber 117, and the third chamber 118 are formed substantially in parallel with one another along the axial direction of the photoconductive drum 102.

Here, on the paper, a direction directed to the first communication section 125 from the second communication section 126 in the first partition wall 114 is defined as a first direction. Further, a direction opposite to the first direction, that is, a direction directed to the second communication section 126 from the first communication section 125 is defined as a second direction.

By the rotation of the first mixer 120, the developer is stirred and conveyed in the first direction and supplied to the developing roller 112. The second mixer 121 and the third mixer 122 stir and convey the developer in the second direction and send the developer to the upstream side of the first mixer 120.

The second mixer 121 and the third mixer 122 are rotationally driven by a drive unit. In the developing device 105, the drive unit includes a drive motor 162 as a single drive source, and a drive gear 163 configured to be rotated by the drive motor 162. To the drive gear 163, a rotation shaft 151 of the third mixer 122 is connected through a large-diameter power transmitting gear 164. Further, to the large-diameter power transmitting gear 164, a rotation shaft 121*a* of the second mixer 121 is connected through a small-diameter power transmitting gear 165.

In the developing device 105 having a configuration described above, the conveyance speed of the developer by the third mixer 122 is lower than the conveyance speed of the developer by the second mixer 121. Therefore, the conveyance time of the developer by the third mixer 122 is longer than the conveyance time of the developer by the second mixer 121.

Here, in another embodiment, the second and third mixers 121 and 122 may be configured to be individually rotationally driven by a plurality of drive motors having different rotational speeds. Further, a reverse feed blade configured to convey the recovered toner in a direction opposite to the second direction may be provided in the third mixer 122. Whatever method is adopted, the conveyance speed of the recovered toner by the third mixer 122 can be made lower than the conveyance speed of the developer by the second mixer 121.

Next, the developing operation of the developing device 105 will be described with reference to FIGS. 2 and 3.

The developer in the development container 111 is stirred and conveyed to the first direction by the rotation of the first mixer 120 and supplied to the developing roller 112. Thereafter, the developer is supplied to an electrostatic latent image on the photoconductive drum 102 by the rotation of the developing roller 112, whereby the electrostatic latent image is made visible.

The developer conveyed from the first mixer 120 is guided into the second chamber 117 through the first communication section 125. Thereafter, in the second chamber 117, the developer is conveyed in the arrow direction (second direction) by the rotation of the second mixer 121. The developer conveyed by the second mixer 121 is sent to the upstream side of the first mixer 120 through the second communication section 126, and conveyed so as to circulate between the first mixer 120 and the second mixer 121.

A portion of the developer conveyed by the second mixer 121 is sent into the third chamber 118 from the third communication section 127 and conveyed in the arrow direction (second direction). The developer is sent into the second chamber 117 again from the fourth communication section 128, and stirred and conveyed by the second mixer 121. Thereafter, the developer is sent to the upstream side of the first mixer 120 through the second communication section 126.

Here, in the developer stirred and conveyed by the second mixer 121, the toner concentration is detected by the toner concentration detector 129. When the toner concentration detected by the toner concentration detector 129 becomes a predetermined value or less, the toner of the embodiment is replenished from the replenishment container 108. This toner drops into the fresh toner receiver 123 of the development container 111. The fresh toner is stirred and conveyed in the arrow direction (second direction) by the rotation of the second mixer 121 and sent to the upstream side of the first mixer 120.

The recovered toner recovered from the cleaning device 107 by the recovery mechanism 110 drops into the recycled toner receiver 124. The recovered toner is conveyed in the second direction by the rotation of the third mixer 122. Here, the developer guided into the third chamber 118 from the third communication section 127 is once stirred and conveyed to the recycled toner receiver 124 side as shown by the arrow a by the rotation of a reverse feed blade 153 of the third mixer 122. Thereafter, the developer is stirred and conveyed in the second direction as shown by the arrow b by the rotation of a forward feed blade 152 together with the recovered toner. The recovered toner is sent to the upstream side of the first mixer 120 sequentially through the fourth communication section 128 and the second communication section 126.

Some of the developer or the recovered toner is sent to the downstream side in the conveyance direction without being sent into the second chamber 117 through the fourth communication section 128. Such a developer or a recovered toner is sent back and returned to the fourth communication section 128 by the rotation of a reverse feed blade 155, and sent to the second chamber 117 through the fourth communication section 128.

In the related art, when a developer containing a toner was reused, an external additive was likely to be detached from toner base particles due to physical stress, and soft caking significantly occurred. Therefore, there was a problem that the fluidity of the developer deteriorated and the electric charge amount and the scattering amount of the toner decreased. On the other hand, the toner of the embodiment has excellent heat resistance, and therefore, when the toner is reused, the fluidity of the toner is less likely to deteriorate. Accordingly, the electric charge amount and the scattering amount of the toner are sufficiently maintained, and favorable development is carried out.

Figure 4:
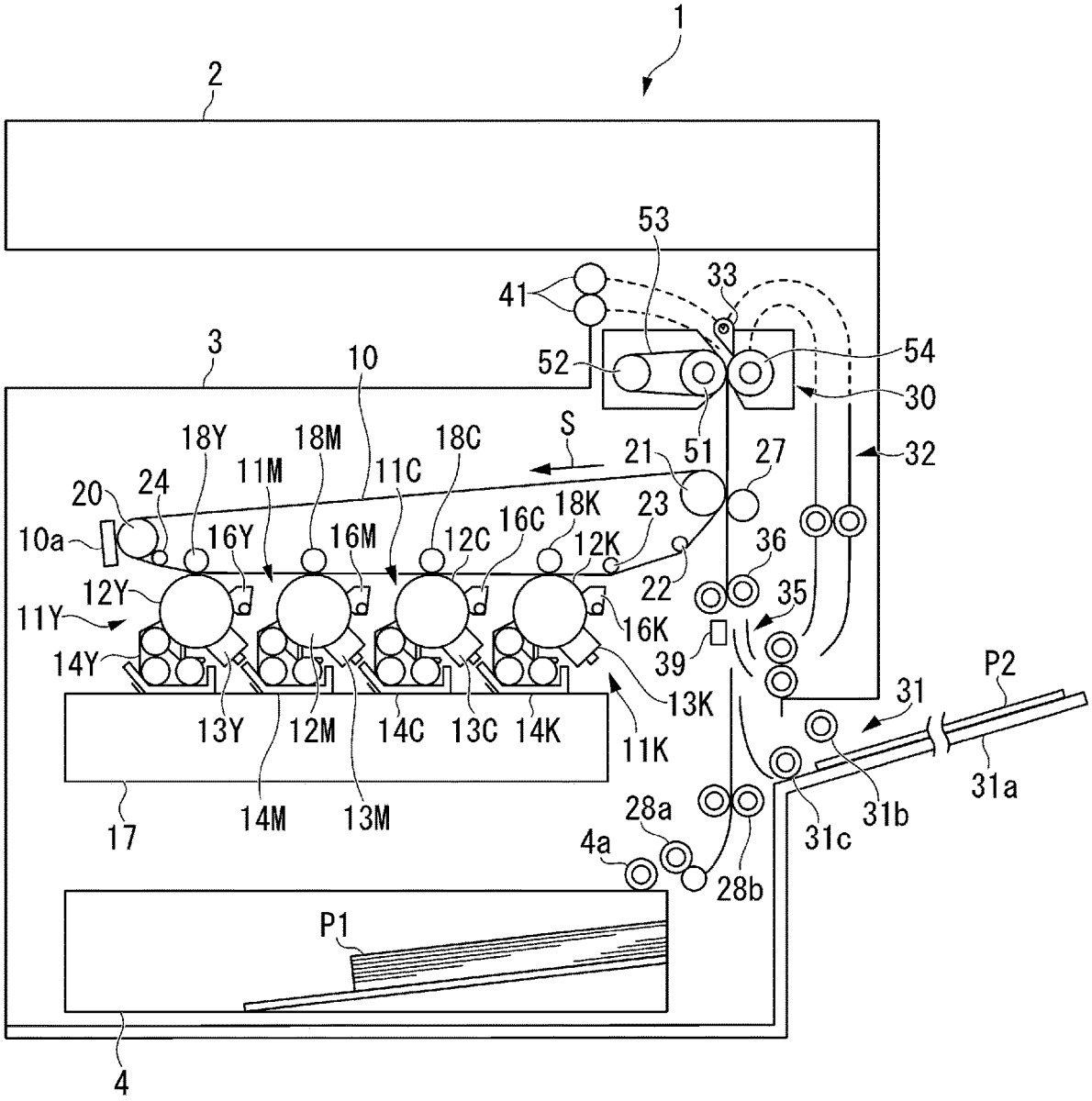
FIG. 4 is a diagram showing an example of a schematic structure of an image forming apparatus of another embodiment.

FIG. 4 shows an example of an image forming apparatus to which a developer containing the toner of the embodiment is applied.

The image forming apparatus shown in FIG. 4 is configured to fix a toner image. However, the image forming apparatus of the embodiment is not limited to the configuration. An image forming apparatus according to another embodiment may be, for example, configured to use an inkjet system.

An image forming apparatus 1 shown in FIG. 4 is a quadruple tandem-type color copier MFP. The image forming apparatus 1 includes a scanner section 2, a paper discharge section 3, a paper feed cassette 4, an intermediate transfer belt 10, four image forming stations 11Y, 11M, 11C, and 11K disposed along the running direction S of the intermediate transfer belt 10, a secondary transfer roller 27, a fixing device 30, and a manual feed mechanism 31.

The intermediate transfer belt 10 is supported by being wound around a driven roller 20 and a backup roller 21. To the intermediate transfer belt 10, an arbitrary tension is applied by a first tension roller 22, a second tension roller 23, and a third tension roller 24 in addition to the driven roller 20 and the backup roller 21.

The image forming stations 11Y, 11M, 11C, and 11K include photoconductive drums 12Y, 12M, 12C, and 12K, respectively, in contact with the intermediate transfer belt 10.

Around the photoconductive drums 12Y, 12M, 12C, and 12K, electrostatic chargers 13Y, 13M, 13C, and 13K, developing devices 14Y, 14M, 14C, and 14K, photoconductor cleaning devices 16Y, 16M, 16C, and 16K, and primary transfer rollers 18Y, 18M, 18C, and 18K are disposed.

The electrostatic chargers 13Y, 13M, 13C, and 13K negatively charge the surfaces of the photoconductive drums 12Y, 12M, 12C, and 12K. A laser exposure device 17 irradiates the photoconductive drums 12Y, 12M, 12C, and 12K with exposure light between the electrostatic charger 13Y, 13M, 13C, or 13K and the developing device 14Y, 14M, 14C, or 14K. Then, electrostatic latent images are formed on the photoconductive drums 12Y, 12M, 12C, and 12K.

The developing devices 14Y, 14M, 14C, and 14K each contain a two-component developer composed of a carrier and each of the toners of yellow (Y), magenta (M), cyan (C), and black (K). The developing devices 14Y, 14M, 14C, and 14K supply the toner to the electrostatic latent images on the photoconductive drums 12Y, 12M, 12C, and 12K, respectively. In this manner, the image forming stations 11Y, 11M, 11C, and 11K form single color images of yellow (Y), magenta (M), cyan (C), and black (K), respectively.

The primary transfer rollers 18Y, 18M, 18C, and 18K are provided on the intermediate transfer belt 10 at positions facing the photoconductive drums 12Y, 12M, 12C, and 12K, respectively. The primary transfer rollers 18Y, 18M, 18C, and 18K are provided for primarily transferring a toner image on each of the photoconductive drums 12Y, 12M, 12C, and 12K to the intermediate transfer belt 10.

The primary transfer rollers 18Y, 18M, 18C, and 18K are each an electrically conductive roller. To each of the primary transfer rollers 18Y, 18M, 18C, and 18K, a primary transfer vias voltage is applied.

The secondary transfer roller 27 is disposed at a transfer position where the intermediate transfer belt 10 is supported by the backup roller 21. The backup roller 21 is an electrically conductive roller. To the backup roller 21, a predetermined secondary transfer bias is applied.

When sheet paper to be printed passes between the intermediate transfer belt 10 and the secondary transfer roller 27, the toner image on the intermediate transfer belt 10 is secondarily transferred onto the sheet paper. After the secondary transfer is completed, the intermediate transfer belt 10 is cleaned by a belt cleaner 10*a*.

The paper feed cassette 4 is provided below the laser exposure device 17. The paper feed cassette 4 feeds sheet paper P1 to the secondary transfer roller 27. Between the paper feed cassette 4 and the secondary transfer roller 27, a pickup roller 4*a*, a separation roller 28*a*, a conveyance roller 28*b*, and a resist roller pair 36 are provided.

The manual feed mechanism 31 is provided in a side face part of the image forming apparatus 1. The manual feed mechanism 31 is provided for manually feeding sheet paper P2. In the manual feed mechanism 31, a manual feed pickup roller 31*b* and a manual feed separation roller 31*c* are provided between a manual feed tray 31*a* and the resist roller pair 36.

On a conveyance path 35 through which sheet paper is conveyed from the paper feed cassette 4 or the manual feed tray 31*a*, a media sensor 39 configured to detect the type of sheet paper is disposed. The image forming apparatus 1 can control the conveyance speed of the sheet paper, the transfer conditions, the fixing conditions, and the like from the detection results by the media sensor 39. The sheet paper is conveyed to the fixing device 30 through the resist roller pair 36 and the secondary transfer roller 27 along the conveyance path 35.

The fixing device 30 includes a fixing belt 53 wound around a set of a heating roller 51 and a drive roller 52, and a counter roller 54 disposed to face the heating roller 51 through the fixing belt 53. The fixing device 30 can heat the fixing belt 53 at a portion in contact with the heating roller 51. Then, the fixing device 30 fixes the toner image to the sheet paper by heating and pressing the sheet paper to which the toner image is transferred between the fixing belt 53 and the counter roller 54.

The toner of the embodiment has excellent low-temperature fixability. Therefore, fixing can be carried out, for example, at about 140 to 170° C.

A gate 33 is provided downstream of the fixing device 30. The sheet paper is distributed in the direction of a paper discharge roller 41 or in the direction of a reconveyance unit 32. The sheet paper distributed to the paper discharge roller 41 is discharged to the paper discharge section 3. Further, the sheet paper distributed to the reconveying unit 32 is guided again to the secondary transfer roller 27.

In the image forming apparatus 1 shown in FIG. 4, the image forming station 11Y integrally includes the photoconductive drum 12Y and a process member and is provided detachably with respect to an image forming apparatus body. As the process member, the electrostatic charger 13Y, the developing device 14Y, and the photoconductor cleaning device 16Y are exemplified. However, in another embodiment, the respective image forming stations 11Y, 11M, 11C, and 11K may be independently detachable with respect to the image forming apparatus or may be detachable with respect to the image forming apparatus as an integrated image forming unit 11.

Figure 5:
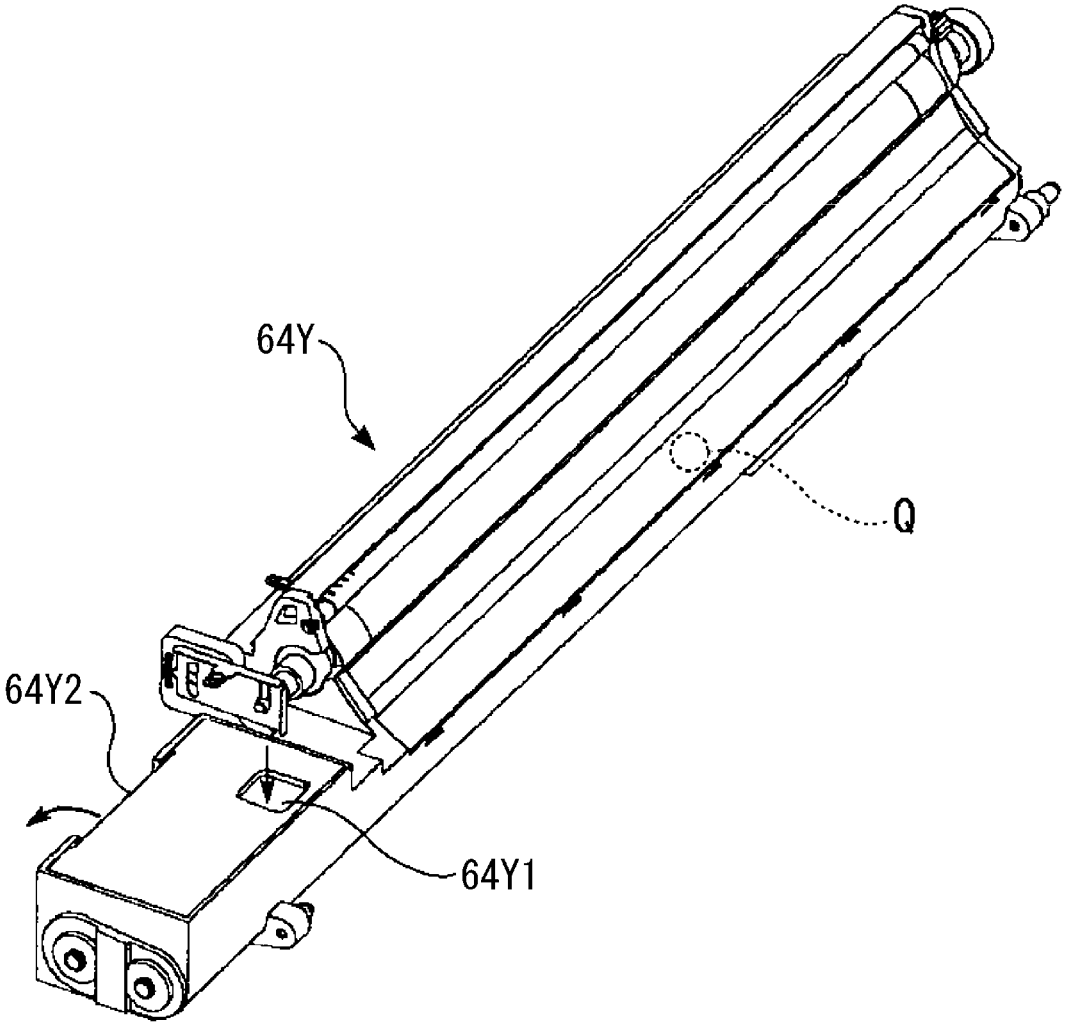
FIG. 5 is a perspective view of a modification of a developing device.

The toner of the embodiment may be applied to the image forming apparatus in which the developing device 14Y of the image forming apparatus shown in FIG. 4 is modified. FIG. 5 shows an example of a modification of a developing device that can be applied to the image forming apparatus shown in FIG. 4.

A developing device 64Y shown in FIG. 5 is configured to store a two-component developer composed of a yellow toner and a carrier. The developing device 64Y includes a toner concentration sensor Q. The toner concentration sensor Q detects a decrease in toner concentration. The developing device 64Y replenishes a yellow toner from a toner cartridge (not shown) when detecting a decrease in concentration. In this manner, the developing device 64Y can maintain the toner concentration constant.

In addition, the developing device 64Y can replenish the carrier through a developer replenishment port 64Y1 from a toner cartridge (not shown). Then, the developing device 64Y can discharge the developer in an amount corresponding to the replenished amount from a developer discharge port 64Y2 by overflowing.

In this manner, in the developing device 64Y, the amount of the developer is maintained constant, and also an old and deteriorated carrier is replaced with a new carrier little by little.

In the same manner as the developing device 14Y, the developing devices 14M, 14C, and 14K in FIG. 4 may also be modified into developing devices 64M, 64C, and 64K (not shown), respectively, each similar to the developing device 64Y except that a magenta toner, a cyan toner, and a black toner are used, respectively, in place of the yellow toner.

The toner of at least one embodiment described above has excellent low-temperature fixability, and also has excellent heat resistance even when the toner is reused, sufficiently maintains an electric charge amount, and hardly decreases an image density.

EXAMPLES

Hereinafter, embodiments are more specifically described by showing Examples.

Preparation of ester waxes A to Q of Examples and ester waxes a to i are described.

Into a four-neck flask equipped with a stirrer, a thermocouple, and a nitrogen introduction tube, 80 parts by mass of at least three or more types of long-chain alkyl carboxylic acids and 20 parts by mass of at least three or more types of long-chain alkyl alcohols were placed. An esterification reaction was performed at 220° C. under a nitrogen gas stream, whereby a reaction product was obtained. To the obtained reaction product, a mixed solvent of toluene and ethanol was added, thereby dissolving the reaction product. Further, a sodium hydroxide aqueous solution was added to the flask, and the resultant was stirred at 70° C. for 30 minutes. Further, the flask was left to stand for 30 minutes to separate the contents of the flask into an organic layer and an aqueous layer, and then, the aqueous layer was removed from the contents. Thereafter, ion exchanged water was added to the flask, and the resultant was stirred at 70° C. for 30 minutes. The flask was left to stand for 30 minutes to separate the contents of the flask into an aqueous layer and an organic layer, and then, the aqueous layer was removed from the contents. This operation was repeated five times. The solvent was distilled off from the organic layer in the contents of the flask under a reduced pressure condition, whereby an ester wax A was obtained.

Ester waxes B to Q were obtained in the same manner as the ester wax A except that the types of the used long-chain alkyl carboxylic acids and long-chain alkyl alcohols, and the used amounts thereof were changed. Further, the ester waxes a to i were obtained by the same procedure.

The used long-chain alkyl carboxylic acids are as follows.

Palmitic acid ($C_{16}H_{32}O_2$)
Stearic acid ($C_{18}H_{36}O_2$)
Arachidonic acid ($C_{20}H_{40}O_2$)
Behenic acid ($C_{22}H_{44}O_2$)
Lignoceric acid ($C_{24}H_{48}O_2$)
Cerotic acid ($C_{26}H_{52}O_2$)
Montanic acid ($C_{28}H_{56}O_2$)

The used long-chain alkyl alcohols are as follows.

Palmityl alcohol ($C_{16}H_{34}O$)
Stearyl alcohol ($C_{18}H_{38}O$)
Arachidyl alcohol ($C_{20}H_{42}O$)
Behenyl alcohol ($C_{22}H_{46}O$)
Lignoceryl alcohol ($C_{24}H_{50}O$)
Ceryl alcohol ($C_{26}H_{54}O$)
Montanyl alcohol ($C_{28}H_{58}O$)

A toner of Example 1 was produced as follows.

First, the raw materials of toner base particles were placed in a Henschel mixer (manufactured by Mitsui Mining Co., Ltd.) and mixed. Further, the mixture of the raw materials of the toner base particles was melt-kneaded using a twin-screw extruder. The resulting melt-kneaded material was cooled, and then, coarsely pulverized using a hammer mill. The coarsely pulverized material was finely pulverized using a jet pulverizer. The finely pulverized material was classified, whereby toner base particles were obtained.

The composition of the raw materials of the toner base particles is shown below.

| | |
|---|---|
| Crystalline polyester resin | 5 parts by mass |
| Amorphous polyester resin | 84 parts by mass |
| Ester wax A | 5 parts by mass |
| Carbon black | 5 parts by mass |
| Charge control agent (polysaccharide inclusion compound containing Al and Mg) | 1 part by mass |

Subsequently, with respect to 100 parts by mass of the toner base particles of Example 1, an external additive having the following composition was mixed using a Henschel mixer, whereby a toner of Example 1 was produced.

| | |
|---|---|
| Silica particles A | 0.45 parts by mass |
| Silica particles B | 0.75 parts by mass |
| Silica particles C | 0.75 parts by mass |
| Titanium oxide | 0.5 parts by mass |

Toners of Examples 2 to 18 and Comparative Examples 1 to 24 were produced as follows.

First, toner base particles of Examples 2 to 18 and Comparative Examples 1 to 24 were produced in the same manner as in Example 1 except that with respect to the composition of the raw materials of the toner base particles, an ester wax shown in the respective columns of Tables 1 to 3 was used in place of the ester wax A.

Subsequently, toners of Examples 2 to 18 and Comparative Examples 1 to 24 were produced by mixing an external additive with the toner base particles of the respective Examples in the same manner as in Example 1 except that with respect to the silica particles A, the silica particles B, and the silica particles C, the particle diameter $r_A$, the particle diameter $r_B$, the particle diameter $r_C$, the content $w_A$, the content $w_B$, and the content $w_C$ were changed as shown in the respective columns of Tables 1 to 3.

TABLE 1

| | Ester wax | $r_A$ | $r_B$ | $r_C$ | $w_A$ | $w_B$ | $w_C$ | B/A | C/A | $W^{A+B+C}$ | $D_{50}$ | Low-temperature fixability | Storage stability | Fluidity | Scattering amount | Image density |
|---|---|---|---|---|---|---|---|---|---|---|---|---|---|---|---|---|
| Example 1 | A | 12 | 55 | 120 | 0.45 | 0.75 | 0.75 | 1.7 | 1.7 | 1.95 | 8.25 | A | A | A | A | A |
| Example 2 | B | 14 | 55 | 120 | 0.45 | 0.75 | 0.75 | 1.7 | 1.7 | 1.95 | 8.25 | A | A | A | A | A |
| Example 3 | C | 10 | 55 | 120 | 0.45 | 0.75 | 0.75 | 1.7 | 1.7 | 1.95 | 8.25 | A | A | A | A | A |
| Example 4 | D | 12 | 55 | 120 | 0.45 | 0.75 | 0.75 | 1.7 | 1.7 | 1.95 | 8.25 | A | A | A | A | A |
| Example 5 | E | 12 | 55 | 120 | 0.45 | 0.75 | 0.75 | 1.7 | 1.7 | 1.95 | 8.25 | A | A | A | A | A |
| Example 6 | F | 12 | 55 | 120 | 0.45 | 0.75 | 0.75 | 1.7 | 1.7 | 1.95 | 8.25 | A | A | A | A | A |
| Example 7 | G | 12 | 55 | 120 | 0.45 | 0.75 | 0.75 | 1.7 | 1.7 | 1.95 | 8.25 | A | A | A | A | A |
| Example 8 | H | 12 | 55 | 120 | 0.45 | 0.75 | 0.75 | 1.7 | 1.7 | 1.95 | 8.25 | A | A | A | A | A |

TABLE 1-continued

| | Ester wax | $r_A$ | $r_B$ | $r_C$ | $w_A$ | $w_B$ | $w_C$ | B/A | C/A | $W^{A+B+C}$ | $D_{50}$ | Low-temperature fixability | Storage stability | Fluidity | Scattering amount | Image density |
|---|---|---|---|---|---|---|---|---|---|---|---|---|---|---|---|---|
| Example 9 | I | 12 | 55 | 120 | 0.45 | 0.75 | 0.75 | 1.7 | 1.7 | 1.95 | 8.25 | A | A | A | A | A |
| Example 10 | J | 14 | 55 | 120 | 0.45 | 0.75 | 0.75 | 1.7 | 1.7 | 1.95 | 8.25 | A | A | A | A | A |
| Example 11 | K | 10 | 55 | 120 | 0.45 | 0.75 | 0.75 | 1.7 | 1.7 | 1.95 | 8.25 | A | A | A | A | A |
| Example 12 | L | 12 | 40 | 120 | 0.45 | 0.75 | 0.75 | 1.7 | 1.7 | 1.95 | 8.25 | A | A | A | A | A |
| Example 13 | M | 12 | 70 | 120 | 0.45 | 0.75 | 0.75 | 1.7 | 1.7 | 1.95 | 8.25 | A | A | A | A | A |
| Example 14 | N | 12 | 55 | 90 | 0.45 | 0.75 | 0.75 | 1.7 | 1.7 | 1.95 | 8.25 | A | A | A | A | A |
| Example 15 | O | 12 | 55 | 150 | 0.45 | 0.75 | 0.75 | 1.7 | 1.7 | 1.95 | 8.25 | A | A | A | A | A |
| Example 16 | P | 12 | 55 | 120 | 0.1 | 0.5 | 0.5 | 5.0 | 5.0 | 1.1 | 5.5 | A | A | A | A | A |
| Example 17 | Q | 12 | 55 | 120 | 0.8 | 1.1 | 1.1 | 1.4 | 1.4 | 3 | 11 | A | A | A | A | A |
| Example 18 | A | 12 | 55 | 120 | 0.1 | 0.4 | 0.4 | 4.0 | 4.0 | 0.9 | 8.25 | A | B | A | A | A |

TABLE 2

| | Ester wax | $r_A$ | $r_B$ | $r_C$ | $w_A$ | $w_B$ | $w_C$ | B/A | C/A | $W_{A+B+C}$ | $D_{50}$ | Low-temperature fixability | Storage stability | Fluidity | Scattering amount | Image density |
|---|---|---|---|---|---|---|---|---|---|---|---|---|---|---|---|---|
| Comparative Example 1 | a | 12 | 55 | 120 | 0.45 | 0.75 | 0.75 | 1.7 | 1.7 | 1.95 | 8.25 | A | A | B | B | A |
| Comparative Example 2 | b | 12 | 55 | 120 | 0.45 | 0.75 | 0.75 | 1.7 | 1.7 | 1.95 | 8.25 | A | A | B | B | A |
| Comparative Example 3 | c | 12 | 55 | 120 | 0.45 | 0.75 | 0.75 | 1.7 | 1.7 | 1.95 | 8.25 | A | A | B | B | A |
| Comparative Example 4 | d | 12 | 55 | 120 | 0.45 | 0.75 | 0.75 | 1.7 | 1.7 | 1.95 | 8.25 | B | A | A | A | A |
| Comparative Example 5 | e | 12 | 55 | 120 | 0.45 | 0.75 | 0.75 | 1.7 | 1.7 | 1.95 | 8.25 | A | B | B | B | A |
| Comparative Example 6 | f | 12 | 55 | 120 | 0.45 | 0.75 | 0.75 | 1.7 | 1.7 | 1.95 | 8.25 | A | B | A | A | A |
| Comparative Example 7 | g | 12 | 55 | 120 | 0.45 | 0.75 | 0.75 | 1.7 | 1.7 | 1.95 | 8.25 | A | B | B | B | A |
| Comparative Example 8 | h | 12 | 55 | 120 | 0.45 | 0.75 | 0.75 | 1.7 | 1.7 | 1.95 | 8.25 | A | B | B | B | A |
| Comparative Example 9 | i | 12 | 55 | 120 | 0.45 | 0.75 | 0.75 | 1.7 | 1.7 | 1.95 | 8.25 | A | B | B | B | A |
| Comparative Example 10 | A | 9 | 55 | 120 | 0.45 | 0.75 | 0.75 | 1.7 | 1.7 | 1.95 | 8.25 | A | A | A | B | A |
| Comparative Example 11 | A | 15 | 55 | 120 | 0.45 | 0.75 | 0.75 | 1.7 | 1.7 | 1.95 | 8.25 | A | A | A | B | A |
| Comparative Example 12 | A | 12 | 35 | 120 | 0.45 | 0.75 | 0.75 | 1.7 | 1.7 | 1.95 | 8.25 | A | A | B | A | A |
| Comparative Example 13 | A | 12 | 75 | 120 | 0.45 | 0.75 | 0.75 | 1.7 | 1.7 | 1.95 | 8.25 | A | A | A | B | A |

TABLE 3

| | Ester wax | $r_A$ | $r_B$ | $r_C$ | $w_A$ | $w_B$ | $w_C$ | B/A | C/A | $W_{A+B+C}$ | $D_{50}$ | Low-temperature fixability | Storage stability | Fluidity | Scattering amount | Image density |
|---|---|---|---|---|---|---|---|---|---|---|---|---|---|---|---|---|
| Comparative Example 14 | A | 12 | 55 | 85 | 0.45 | 0.75 | 0.75 | 1.7 | 1.7 | 1.95 | 8.25 | A | A | B | A | A |
| Comparative Example 15 | A | 12 | 55 | 160 | 0.45 | 0.75 | 0.75 | 1.7 | 1.7 | 1.95 | 8.25 | A | A | A | B | A |
| Comparative Example 16 | A | 12 | 55 | 120 | 0.09 | 0.5 | 0.5 | 5.6 | 5.6 | 1.09 | 8.25 | A | A | B | B | A |
| Comparative Example 17 | A | 12 | 55 | 120 | 0.9 | 0.9 | 0.9 | 1.0 | 1.0 | 2.7 | 8.25 | A | A | A | A | B |
| Comparative Example 18 | A | 12 | 55 | 120 | 0.2 | 0.2 | 0.75 | 1.0 | 3.8 | 1.15 | 8.25 | A | A | A | B | A |
| Comparative Example 19 | A | 12 | 55 | 120 | 0.2 | 0.75 | 0.2 | 3.8 | 1.0 | 1.15 | 8.25 | A | A | B | A | A |
| Comparative Example 20 | A | 12 | 55 | 120 | 0.45 | 0.4 | 0.75 | 0.9 | 1.7 | 1.6 | 8.25 | A | A | B | A | A |

TABLE 3-continued

| | Ester wax | $r_A$ | $r_B$ | $r_C$ | $w_A$ | $w_B$ | $w_C$ | B/A | C/A | $W_{A+B+C}$ | $D_{50}$ | Low-temperature fixability | Storage stability | Fluidity | Scattering amount | Image density |
|---|---|---|---|---|---|---|---|---|---|---|---|---|---|---|---|---|
| Comparative Example 21 | A | 12 | 55 | 120 | 0.45 | 0.75 | 0.4 | 1.7 | 0.9 | 1.6 | 8.25 | A | A | B | A | A |
| Comparative Example 22 | A | 12 | 55 | 120 | 0.7 | 1.2 | 1.2 | 1.7 | 1.7 | 3.1 | 8.25 | B | A | A | A | A |
| Comparative Example 23 | A | 12 | 55 | 120 | 0.45 | 0.75 | 0.75 | 1.7 | 1.7 | 1.95 | 5 | A | A | B | A | A |
| Comparative Example 24 | A | 12 | 55 | 120 | 0.45 | 0.75 | 0.75 | 1.7 | 1.7 | 1.95 | 11.5 | A | A | A | A | B |

A method for measuring the carbon number distribution of the ester compounds (the proportion of each of the ester compounds with the corresponding carbon number) constituting the ester wax is described.

0.5 g of each of the toners of the respective Examples was weighed and placed in an Erlenmeyer flask. Subsequently, 2 mL of methylene chloride was added to the Erlenmeyer flask to dissolve the toner. Further, 4 mL of hexane was added to the Erlenmeyer flask to form a mixed liquid. The mixed liquid was filtered and separated into a filtrate and an insoluble material. The solvent was distilled off from the filtrate under a nitrogen gas stream, whereby a deposited material was obtained. With respect to the deposited material, the carbon number distribution of the ester compounds in the ester wax extracted from the toner was measured.

The proportion of each of the ester compounds with the corresponding carbon number was measured using FD-MS "JMS-T100GC (manufactured by JEOL Ltd.)". The measurement conditions are as follows.

Sample concentration: 1 mg/mL (solvent: chloroform)

Cathode voltage: −10 kv

Spectral recording interval: 0.4 s

Measurement mass range (m/z): between 10 and 2000

The total ionic strength of the ester compounds with the corresponding carbon number obtained by the measurement was assumed to be 100. The relative value of the ionic strength of each of the ester compounds with the corresponding carbon number with respect to the total ionic strength was determined. The relative value was defined as the proportion of each of the ester compounds with the corresponding carbon number in the ester wax. Further, the carbon number of the ester compound with a carbon number, the relative value of which is highest, was denoted by $C_1$.

A method for analyzing the first monomer group and the second monomer group is described.

1 g of each ester wax was subjected to a methanolysis reaction under the conditions of a temperature of 70° C. for 3 hours. The product after the methanolysis reaction was subjected to mass spectrometry using FD-MS, and the content of each of the long-chain alkyl carboxylic acids with the corresponding carbon number and the content of each of the long-chain alkyl alcohols with the corresponding carbon number were determined.

A method for measuring the carbon number distribution of the carboxylic acids (the proportion of each of the carboxylic acids with the corresponding carbon number) constituting the first monomer group is described.

The proportion of each of the carboxylic acids with the corresponding carbon number was measured using FD-MS "JMS-T100GC (manufactured by JEOL Ltd.)". The measurement conditions are as follows.

Sample concentration: 1 mg/mL (solvent: chloroform)

Cathode voltage: −10 kv

Spectral recording interval: 0.4 s

Measurement mass range (m/z): between 10 and 2000

The total ionic strength of the carboxylic acids with the corresponding carbon number obtained by the measurement was assumed to be 100. The relative value of the ionic strength of each of the carboxylic acids with the corresponding carbon number with respect to the total ionic strength was determined. The relative value was defined as the proportion of each of the carboxylic acids with the corresponding carbon number in the ester wax. Further, the carbon number of the carboxylic acid with a carbon number, the relative value of which is highest, was denoted by $C_n$.

A method for measuring the carbon number distribution of the alcohols (the proportion of each of the alcohols with the corresponding carbon number) constituting the second monomer group is described.

The proportion of each of the alcohols with the corresponding carbon number was measured using FD-MS "JMS-T100GC (manufactured by JEOL Ltd.)". The measurement conditions are as follows.

Sample concentration: 1 mg/mL (solvent: chloroform)

Cathode voltage: −10 kv

Spectral recording interval: 0.4 s

Measurement mass range (m/z): between 10 and 2000

The total ionic strength of the alcohols with the corresponding carbon number obtained by the measurement was assumed to be 100. The relative value of the ionic strength of each of the alcohols with the corresponding carbon number with respect to the total ionic strength was determined. The relative value was defined as the proportion of each of the alcohols with the corresponding carbon number in the ester wax. Further, the carbon number of the alcohol with a carbon number, the relative value of which is highest, was denoted by $C_m$.

The ester waxes A to Q used in the respective Examples will be described.

In all the ester waxes A to Q, the carbon number $C_1$ of the ester compound, the content of which is highest, was 44, the carbon number $C_n$ of the carboxylic acid, the content of which is highest in the first monomer group, was 22, and the carbon number $C_m$ of the alcohol, the content of which is highest in the second monomer group, was 20.

With respect to the ester waxes A to Q, the carbon number distribution of the ester wax had only one maximum peak in a region where the carbon number is 43 or more.

The properties of the ester waxes A to Q obtained from the measurement results of mass distribution are shown in Table 4. Further, the properties of the ester waxes a to i are shown in Table 5.

TABLE 4

| | $a_1$ | $a_2$ | $b_1$ | $b_2$ | $c_1$ | $c_2$ |
|---|---|---|---|---|---|---|
| Ester wax A | 4 | 3 | 3 | 15 | 82.5 | 80 |
| Ester wax B | 3 | 3 | 2 | 15 | 95 | 70 |
| Ester wax C | 3 | 3 | 0 | 5 | 90 | 90 |
| Ester wax D | 3 | 4 | 0 | 5 | 90 | 90 |
| Ester wax E | 3 | 3 | 5 | 18 | 85 | 82 |
| Ester wax F | 4 | 3 | 3 | 15 | 70 | 70 |
| Ester wax G | 4 | 3 | 3 | 15 | 70 | 70 |
| Ester wax H | 4 | 3 | 3 | 15 | 70 | 70 |
| Ester wax I | 4 | 3 | 3 | 15 | 70 | 70 |
| Ester wax J | 4 | 3 | 3 | 15 | 82.5 | 80 |
| Ester wax K | 4 | 3 | 3 | 15 | 82.5 | 80 |
| Ester wax L | 4 | 3 | 3 | 15 | 82.5 | 80 |
| Ester wax M | 4 | 3 | 3 | 15 | 82.5 | 80 |
| Ester wax N | 4 | 3 | 3 | 15 | 82.5 | 80 |
| Ester wax O | 4 | 3 | 3 | 15 | 82.5 | 80 |
| Ester wax P | 4 | 3 | 3 | 15 | 82.5 | 80 |
| Ester wax Q | 4 | 3 | 3 | 15 | 82.5 | 80 |

TABLE 5

| | $a_1$ | $a_2$ | $b_1$ | $b_2$ | $c_1$ | $c_2$ |
|---|---|---|---|---|---|---|
| Ester wax a | 5 | 3 | 1 | 38 | 65 | 55 |
| Ester wax b | 3 | 4 | 5 | 38 | 70 | 60 |
| Ester wax c | 3 | 3 | 10 | 15 | 60 | 60 |
| Ester wax d | 3 | 3 | 10 | 40 | 85 | 50 |
| Ester wax e | 4 | 5 | 10 | 40 | 80 | 50 |
| Ester wax f | 2 | 3 | 5 | 15 | 95 | 85 |
| Ester wax g | 3 | 2 | 3 | 5 | 90 | 95 |
| Ester wax h | 3 | 2 | 3 | 5 | 90 | 95 |
| Ester wax i | 1 | 1 | 100 | 100 | 100 | 100 |

In Tables 4 and 5, $a_1$ is the number of types [types] of carboxylic acids in the first monomer group. $a_2$ is the number of types [types] of alcohols in the second monomer group. $b_1$ is the total proportion [mass %] of the carboxylic acids with a carbon number of 18 or less with respect to 100 mass % of the first monomer group. $b_2$ is the total proportion [mass %] of the alcohols with a carbon number of 18 or less with respect to 100 mass % of the second monomer group. $c_1$ is the proportion [mass %] of the carboxylic acid with a carbon number of $C_n$ with respect to 100 mass % of the first monomer group. $c_2$ is the proportion [mass %] of the alcohol with a carbon number of $C_m$ with respect to 100 mass % of the second monomer group.

A method for measuring the volume average primary particle diameter: $D_{50}$ of each of the toners of the respective Examples will be described.

A laser diffraction particle size distribution analyzer (manufactured by Shimadzu Corporation (SALD-7000)) was used.

Developers of Examples will be described.

With respect to 100 parts by mass of ferrite carrier, 8.5 parts by mass of each of the toners of the respective Examples was stirred using a Turbula mixer, whereby developers of the respective Examples were obtained. The surface of the ferrite carrier is coated with a silicone resin having an average particle diameter of 40 μm.

A method for evaluating the low-temperature fixability is described.

Each of the developers of the respective Examples was stored in a toner cartridge. The toner cartridge was placed in an image forming apparatus for evaluating the low-temperature fixability. The image forming apparatus for evaluating the low-temperature fixability is an apparatus obtained by modifying commercially available e-studio 5018A (manufactured by Toshiba Tec Corporation) so that the fixing temperature can be set by changing the temperature by 0.1° C. at a time between 100° C. and 200° C. By using the image forming apparatus for evaluating the low-temperature fixability and setting the fixing temperature to 150° C., 10 sheets of a solid image at a toner adhesion amount of 1.5 mg/cm$^2$ were obtained. When image peeling due to offset or unfixing did not occur on all the 10 sheets of the solid image, the set temperature was decreased by 1° C., and a solid image was obtained in the same manner as described above. This operation was repeated, and the lower limit temperature of the fixing temperature at which image peeling did not occur on the solid image was determined, and the lower limit temperature was defined as the lowest fixing temperature of the toner. When the lowest fixing temperature was 120° C. or lower, the low-temperature fixability of the toner was evaluated as pass (A). When the lowest fixing temperature was higher than 120° C., the low-temperature fixability of the toner was evaluated as fail (B).

A method for evaluating the storage stability is described.

Each of the toners of the respective Examples was left at 55° C. for 10 hours. 15 g of each of the toners of the respective Examples after being left at 55° C. for 10 hours was sieved through a mesh with an opening of 0.07 mm, and the toner remaining on the mesh was weighed. As the amount of the toner remaining on the mesh is smaller, the storage stability is superior. When the amount of the toner remaining on the mesh was 3 g or less, the storage stability of the toner was evaluated as pass (A). When the amount of the toner remaining on the mesh was more than 3 g, the storage stability of the toner was evaluated as fail (B).

A method for evaluating the heat resistance is described.

When the evaluation results of the following "fluidity" and "scattering amount" were both pass (A), the heat resistance was evaluated as excellent.

A method for evaluating the "fluidity" is described.

Each of the developers of the respective Examples was stored in a toner cartridge. The toner cartridge was placed in an image forming apparatus for evaluating the heat resistance. The image forming apparatus for evaluating the heat resistance is an apparatus in which a thermocouple was attached to the developing device of commercially available e-studio 5018A (manufactured by Toshiba Tec Corporation). By using the image forming apparatus for evaluating the heat resistance, a solid image and a half-tone image were continuously copied on 1000 sheets of A4 size paper in a high temperature and high humidity environment (30° C., 85% humidity). Whether or not a defective image occurred was confirmed every time the temperature in the developing device was raised by 2° C. while copying, and the temperature at which a defective image started to occur was recorded. When the temperature at which a defective image started to occur was 45° C. or higher, the fluidity of the toner was evaluated as pass (A). When the temperature at which conveyance failure or a defective image started to occur was lower than 45° C., the fluidity of the toner was evaluated as fail (B).

A method for evaluating the "scattering amount" is described.

By using commercially available e-studio 5018A (manufactured by Toshiba Tec Corporation), an original document with a printing ratio of 8.0% was continuously copied on 200,000 sheets of A4 size paper. Thereafter, the toner deposited below a magnet roller of the developing device was sucked with a vacuum cleaner, and the deposited toner amount was measured as the scattering toner amount. When the scattering toner amount was 170 mg or less, the electric charge amount of the toner was evaluated as pass (A). When the scattering toner amount was more than 170 mg, the electric charge amount of the toner was evaluated as fail (B).

A method for evaluating the image density is described.

Each of the developers of the respective Examples was stored in a toner cartridge. The toner cartridge was placed in commercially available e-studio 5018A (manufactured by Toshiba Tec Corporation). The toner concentration in the developer was adjusted to 8.0% in a low temperature and low humidity environment (10° C., 20% humidity), and a solid image was printed on A4 size paper. The density of the obtained solid image was measured with a Macbeth densitometer, and when the density was 1.0 or more, the image density was evaluated as pass (A). When the density of the solid image was less than 1.0, the image density was evaluated as fail (B).

The evaluation results of the low-temperature fixability, storage stability, fluidity, scattering amount, and image density of each of the toners of the respective Examples are shown in Tables 1 to 3. In Tables 1 to 3, "$D_{50}$" is the volume average primary particle diameter $D_{50}$ [μm] of each of the toners of the respective Examples.

The toners of Examples 1 to 18 had excellent low-temperature fixability and heat resistance, and did not decrease the image density. Further, the scattering toner amount was small, and the electric charge amount was sufficiently maintained in the image forming apparatus. The e-studio 5018A is an image forming apparatus in which the toner is reused. Therefore, the toners of Examples 1 to 18 have excellent heat resistance even when the toners are reused, and sufficiently maintain an electric charge amount, and also hardly decrease the image density.

In addition, the toners of Examples 1 to 17 also had excellent storage stability.

On the other hand, the toners of Comparative Examples 1 to 24 did not simultaneously meet the pass criteria for all the low-temperature fixability, storage stability, heat resistance, and image density.

While certain embodiments of the invention have been described, these embodiments have been presented by way of example only, and are not intended to limit the scope of the invention. The embodiments described herein may be embodied in various other forms, and various omissions, substitutions, and changes may be made without departing from the gist of the invention. The embodiments and modifications thereof are included in the scope and gist of the invention and also included in the invention described in the claims and in the scope of their equivalents.

What is claimed is:

1. A toner comprising:

toner base particles; and an external additive attached to surfaces of the toner base particles, wherein the toner base particles contain a crystalline polyester resin and an ester wax, the ester wax is a condensation polymer of a first monomer group comprising at least three or more types of carboxylic acids and a second monomer group comprising at least three or more types of alcohols, the proportion of a carboxylic acid with a carbon number of $C_n$, the content of which is highest in the first monomer group, is between 70 and 95 mass % with respect to 100 mass % of the first monomer group, the proportion of a carboxylic acid with a carbon number of 18 or less in the first monomer group is 5 mass % or less with respect to 100 mass % of the first monomer group, the proportion of an alcohol with a carbon number of $C_m$, the content of which is highest in the second monomer group, is between 70 and 90 mass % with respect to 100 mass % of the second monomer group, the proportion of an alcohol with a carbon number of 18 or less in the second monomer group is 20 mass % or less with respect to 100 mass % of the second monomer group, the external additive contains silica particles A having a particle diameter $r_A$ of 10 to 14 nm, silica particles B having a particle diameter $r_B$ of 40 to 70 nm, and silica particles C having a particle diameter $r_C$ of 90 to 150 nm, the content of the silica particles A is between 0.1 and 0.8 parts by mass with respect to 100 parts by mass of the toner base particles, the content of the silica particles B is between 0.3 and 1.2 parts by mass with respect to 100 parts by mass of the toner base particles, the content of the silica particles C is between 0.3 and 1.2 parts by mass with respect to 100 parts by mass of the toner base particles, the sum of the content of the silica particles A, the content of the silica particles B, and the content of the silica particles C is 3.0 parts by mass or less with respect to 100 parts by mass of the toner base particles, the ratio of the content of the silica particles B to the content of the silica particles A is between 1.0 and 5.0, the ratio of the content of the silica particles C to the content of the silica particles A is between 1.0 and 5.0, and the volume average primary particle diameter D50 of the toner is between 5.5 and 11.0 μm.

2. The toner according to claim 1, wherein at least three maximum peaks of silica particles are present in a particle size distribution measured for the external additive, and at least one maximum peak is present in each of the ranges from 10 to 14 nm, from 40 to 70 nm, and from 90 to 150 nm.

3. The toner according to claim 1, wherein the sum of the content of the silica particles A, the content of the silica particles B, and the content of the silica particles C is 1.0 parts by mass or less with respect to 100 parts by mass of the toner base particles.

4. The toner according to claim 1, wherein the crystalline polyester resin has amass average molecular weight between $6\times10^3$ and $18\times10^3$.

5. The toner according to claim 1, wherein the crystalline polyester resin has a melting point between 60 and 120° C.

6. The toner according to claim 1, wherein the carbon number $C_n$ is between 19 and 28.

7. The toner according to claim 1, wherein the carbon number $C_m$ is between 19 and 28.

8. The toner according to claim 1, wherein the crystalline polyester resin is present in an amount of between 5 and 25 mass % with respect to 100 mass % of the toner base particles.

9. The toner according to claim 1, wherein the ester wax is present in an amount of between 3 and 15 mass % with respect to 100 mass % of the toner base particles.

10. The toner according to claim 1, wherein the silica particles A have a particle diameter $r_A$ between 11 to 13 nm.

11. The toner according to claim 1, wherein the silica particles B have a particle diameter $r_B$ between 45 to 65 nm.

12. The toner according to claim 1, wherein the silica particles C have a particle diameter $r_C$ between 100 to 140 nm.

13. The toner according to claim 1, wherein the sum of the content of the silica particles A, the content of the silica particles B, and the content of the silica particles C is between 1 and 3 parts by mass with respect to 100 parts by mass of the toner base particles.

14. The toner according to claim 1, wherein the ratio of the content of the silica particles B to the content of the silica particles A is between 2.0 and 4.5.

15. The toner according to claim 1, wherein the ratio of the content of the silica particles C to the content of the silica particles A is between 1.5 and 4.0.

16. The toner according to claim 1, wherein the volume average primary particle diameter $D_{50}$ of the toner is between 5.8 and 10.0 μm.

17. The toner according to claim 1, further comprising a colorant, a charge control agent, a surfactant, a basic compound, an aggregating agent, a pH adjusting agent, an antioxidant, or any combination thereof.

18. A toner cartridge comprising a container comprising the toner according to claim 1.

19. An image forming apparatus comprising the toner cartridge according to claim 18.

* * * * *